US009568267B2

(12) United States Patent
Lung et al.

(10) Patent No.: US 9,568,267 B2
(45) Date of Patent: Feb. 14, 2017

(54) CONFIGURABLE WEAPON STATION HAVING UNDER ARMOR RELOAD

(71) Applicant: MOOG INC., East Aurora, NY (US)

(72) Inventors: Kevin Lung, Wadsworth, IL (US); Frank Mueller, Santa Ynez, CA (US); David Rhodes, Solvang, CA (US)

(73) Assignee: Moog Inc., East Aurora, NY (US)

( * ) Notice: Subject to any disclaimer, the term of this patent is extended or adjusted under 35 U.S.C. 154(b) by 0 days.

(21) Appl. No.: 14/802,748

(22) Filed: Jul. 17, 2015

(65) Prior Publication Data

US 2016/0025441 A1 Jan. 28, 2016

Related U.S. Application Data

(63) Continuation-in-part of application No. 14/337,422, filed on Jul. 22, 2014, now Pat. No. 9,464,856.

(51) Int. Cl.

| | |
|---|---|
| ***F41A 23/24*** | (2006.01) |
| ***F41A 9/34*** | (2006.01) |
| ***F41A 27/18*** | (2006.01) |

(52) U.S. Cl.

CPC ..... *F41A 23/24* (2013.01); *F41A 9/34* (2013.01); *F41A 27/18* (2013.01)

(58) Field of Classification Search

CPC ..... F41A 23/24; F41A 23/26; F41A 23/00; F41A 27/02; F41A 27/22; F41A 27/06; F41A 27/24; F41A 27/2728; F41A 27/18; F41A 27/20

USPC ..... 89/37.01–37.04, 37.11–37.17, 41.01,89/41.02

See application file for complete search history.

(56) References Cited

U.S. PATENT DOCUMENTS

| | | | | |
|---|---|---|---|---|
| 425,656 | A | 4/1890 | Canet | |
| 1,031,279 | A | 7/1912 | Maxim | |
| 1,742,436 | A | 1/1930 | Dabrasky | |
| 1,845,508 | A | 2/1932 | Minshall | |
| 2,470,475 | A | 9/1945 | Diaper | |
| 2,573,774 | A | 2/1948 | Sandberg | |
| 2,519,129 | A | 8/1950 | Frise | |
| 2,520,736 | A | 8/1950 | Reek et al. | |
| 2,833,182 | A | 12/1955 | Houston et al. | |
| 2,960,009 | A | 11/1960 | Hereth et al. | |
| 3,439,964 | A * | 4/1969 | Stone | F16C 23/045 384/208 |
| 4,144,797 | A | 3/1979 | Berge et al. | |
| 4,433,609 | A | 2/1984 | Darnall | |
| 4,574,685 | A * | 3/1986 | Sanborn | F41A 23/34 89/36.13 |
| 4,576,085 | A | 3/1986 | LeBlanc | |
| 5,056,409 | A | 10/1991 | Allais et al. | |
| 5,111,729 | A | 5/1992 | Tassie | |

(Continued)

*Primary Examiner* — Joshua Freeman

(74) *Attorney, Agent, or Firm* — Hodgson Russ LLP

(57) ABSTRACT

A vehicle-mounted weapon station is configurable to adjust the height of a rotational elevation axis thereof. The weapon station is provided with at least one fixed hanging ammunition container that is reloadable under the armored protection of the vehicle and the weapon station shell. The weapon station may have both electrically-powered and manually-powered drive systems for rotating a pedestal about an azimuth axis relative to the vehicle, and for rotating weaponry and operational units about the elevation axis, wherein the electrical and manual drive systems transmit power through the same output gear.

8 Claims, 35 Drawing Sheets

(56) References Cited

U.S. PATENT DOCUMENTS

| | | | | |
|---|---|---|---|---|
| 5,419,234 | A * | 5/1995 | Sanderson | B64D 7/00 89/33.16 |
| 6,286,411 | B1 | 9/2001 | Sanderson | |
| 6,439,098 | B1 | 8/2002 | Dillon | |
| 7,030,579 | B1 | 4/2006 | Schmitz et al. | |
| 7,047,863 | B2 | 5/2006 | Hawkes et al. | |
| 7,185,575 | B1 | 3/2007 | Collier et al. | |
| 7,293,493 | B2 * | 11/2007 | Persson | F41G 3/165 89/41.02 |
| 7,600,462 | B2 | 10/2009 | Quinn | |
| 7,669,513 | B2 | 3/2010 | Niv et al. | |
| 7,798,050 | B2 | 9/2010 | Sembtner | |
| 7,908,957 | B1 | 3/2011 | Leung | |
| 8,215,225 | B1 | 7/2012 | Zangrando | |
| 8,245,624 | B1 * | 8/2012 | Green | F41A 27/18 89/41.01 |
| 8,459,171 | B2 | 6/2013 | Cottle | |
| 8,646,374 | B2 | 2/2014 | Shacklee et al. | |
| 8,763,511 | B2 | 7/2014 | Schvartz et al. | |
| 8,910,559 | B1 | 12/2014 | Berman | |
| 2004/0050240 | A1 | 3/2004 | Greene et al. | |
| 2004/0134340 | A1 | 7/2004 | Quinn | |
| 2007/0119296 | A1 * | 5/2007 | Niv | F41A 23/20 89/37.02 |
| 2007/0209501 | A1 * | 9/2007 | Ko | F41A 23/24 89/40.01 |
| 2007/0261544 | A1 | 11/2007 | Philippe | |
| 2008/0017426 | A1 | 1/2008 | Walters et al. | |
| 2008/0148931 | A1 | 6/2008 | Svensson et al. | |
| 2010/0126338 | A1 | 5/2010 | Rastegar et al. | |
| 2010/0257999 | A1 * | 10/2010 | Domholt | F41A 27/20 89/41.02 |
| 2012/0024143 | A1 | 2/2012 | Shacklee et al. | |
| 2012/0186423 | A1 | 7/2012 | Chachamian et al. | |
| 2013/0000473 | A1 * | 1/2013 | Schvartz | F41A 9/34 89/33.2 |
| 2013/0068584 | A1 | 3/2013 | Lim et al. | |
| 2013/0069581 | A1 | 3/2013 | Lim et al. | |
| 2013/0220109 | A1 | 8/2013 | Berkovich et al. | |
| 2013/0327205 | A1 | 12/2013 | Mons et al. | |
| 2015/0082977 | A1 | 3/2015 | Tikochinski et al. | |
| 2015/0267989 | A1 * | 9/2015 | Hobson | F41A 23/24 89/37.12 |

* cited by examiner

CONFIGURABLE WEAPON STATION HAVING UNDER ARMOR RELOAD

FIELD OF THE INVENTION

The present invention relates generally to the field of remote-controlled weapon stations or systems (RWSs) and manned weapon stations, and more particularly to vehicle-mounted weapon stations designed to mount over a hatch opening in a top deck of a vehicle.

BACKGROUND OF THE INVENTION

Vehicle-mounted weapon stations are retrofittable to various types of military vehicles, including but not limited to armored combat vehicles (ACVs), mine-resistant ambush protected (MRAP) vehicles, armored multi-purpose vehicles (AMPVs), amphibious assault vehicles (AAVs), and light armored vehicles (LAVs). The weapon stations allows personnel to operate externally-mounted weapons from the within the armored protection of the vehicle.

A weapon station may be outfitted with selected weapons (e.g. guns and missile launchers), and non-lethal operating units (e.g. target sighting units, acoustic hailers, and illuminators), to provide desired performance capabilities. Missile launchers suitable for use in a weapon station include, without limitation, a Hellfire missile launcher, a Javelin missile launcher, and a TOW missile launcher. Automatic guns that process linked ammunition are favored in weapon station configurations. Some of the guns falling into this category are the MK44 chain gun, CTAT 30 mm and 40 mm canons, the M242 chain gun, the M230LF autocannon, the M2 machine gun, the M3 submachine gun, the MK19 automatic grenade launcher, the M240 machine gun, the M249 light machine gun, and the M134 machine gun. Of course, a weapon station may be outfitted with weapons and operating units other than those specifically mentioned above.

The linked ammunition typically comes in the form of a long ammunition belt held within an ammunition container. The belt extends out through an exit opening in the container to an ammunition feed mechanism at the gun. As an existing ammunition belt advances and is used up during firing, a leading link of a subsequent ammunition belt may be coupled to a trailing link of the existing belt to accomplish reloading. In some systems, the new belt is loaded into the existing container, while in other systems, the existing emptied container is removed and replaced with a new container holding the new belt.

One type of ammunition container designed to be reloaded when emptied is a hanging ammunition or suspended ammunition container. In this known arrangement, an ammunition belt is folded in serpentine fashion within the ammunition container, with upper links in the belt being supported by parallel rails at or near the top of the container so as to suspend or hang folded vertical segments of the belt in the container. This type of "hanging ammo" arrangement is described, for example, in U.S. Pat. No. 2,573,774 (Sandberg); U.S. Pat. No. 4,433,609 (Darnall); and U.S. Pat. No. 8,763,511 (Schvartz et al.).

In designing a weapon station, it is desirable to provide personnel with the capability to reload the externally mounted automatic guns with linked ammunition while the personnel remain within the relatively safe confines of the armored vehicle. U.S. Patent Application Publication No. 2012/0186423 (Chachamian et al.) describes a system for protected reloading of an RWS. The system comprises an extendable and retractable support bracket having a top plate attached to the RWS and a bottom plate for receiving and supporting an ammunition container. The bottom plate is connected to the top plate by four gas pistons enabling the bottom plate carrying the ammunition box to be raised up into the RWS turret for regular use and lowered down into the vehicle compartment for reloading. While the system enables reloading under armored protection, it requires a mechanically complicated bracket and uses space within the vehicle compartment to accommodate the lowered ammunition container during reloading. Given that the vehicle compartment is already very confined, this solution is not optimal.

Another system for under armor reloading of ammunition is described in the aforementioned U.S. Pat. No. 8,763,511 (Schvartz et al.). The ammunition containers disclosed by Schvartz et al. are open at the front end and the rear end such that multiple containers may be stowed end-to-end in the RWS with their belts linked for regular use. An elevator mechanism is provided to lift ammunition containers from the vehicle compartment through a hatch and into the RWS. When a rearmost container is emptied, it is removed manually or using the elevator to make room for another container. Here again, the system enables reloading under armored protection, but it requires an elevator mechanism and uses valuable space within the vehicle compartment. The system also dedicates limited space within the RWS pedestal for multiple ammunition cans associated with only a single weapon.

With respect to weapons configuration, weapon station design has been limited by a "point solution" mindset. In other words, weapons stations are predominantly designed with a specific weapon configuration in mind. This mindset is understandable, given that the weapon station must incorporate sophisticated motion drive and stabilization systems to rotate the station turret or pedestal about an azimuth axis, and to rotate a mounted weapon about an elevation axis, with precision and accuracy. By focusing on one or perhaps a few weapon configurations, weapon station designers can limit the loading variables that must be accommodated and can optimize the weapon support and motion drive systems. However, this "point solution" mindset may be detrimental to combat preparedness because a weapon station having a fixed weapon configuration may become ill-suited for combat as battle conditions change.

The height of the weapon station elevation axis is an example of a weapon station design parameter that limits the available weapon configurations. A relatively low elevation axis is useful for shorter barrel guns and gives the armored vehicle a desirably low profile. However, an weapon station with a relatively low elevation axis cannot accommodate certain longer barrel guns and missile launchers. U.S. Pat. No. 7,669,513 (Niv et al.) teaches an RWS intended to have a variety of weapon configurations. The RWS has an automated vertically-adjustable linkage on which a weapon mount is carried for adjusting the height of the weapon elevation axis. This type of system introduces other costs, complexities, and possible malfunction points to the RWS.

What is needed is a weapon station that enables reloading of ammunition under armor without using valuable space within the vehicle compartment and without relying on a conveyor mechanism.

What is also needed is a mechanically simple weapon station that can be readily outfitted with a variety of weapon configurations depending upon changing combat requirements.

It is further desired to provide a basic vehicle-mounted weapon station apparatus that may be adapted to provide a manned weapon station depending upon operational requirements.

In the event of power outages, it is highly desirable to provide for manually powered movements of the pedestal about the azimuth axis, and manually powered movements of weaponry and operational units about the elevation axis. The apparatus for enabling manually powered movements should be space-efficient and compact.

SUMMARY OF THE INVENTION

In embodiments of the present invention, a weapon station is configurable to adjust the height of a rotational elevation axis thereof by providing interchangeable pairs of removably mounted yoke arms, wherein the pairs have different heights.

The configurable weapon station apparatus comprises a pedestal adapted to be mounted on an armored vehicle for rotation relative to the armored vehicle about an azimuth axis. The pedestal includes a pair of laterally-spaced yoke arm attachment interfaces. The apparatus also comprises a first pair of elevation yoke arms and a second pair of elevation yoke arms selectively exchangeable with the first pair of elevation yoke arms in being removably mounted on the pedestal. The yoke arms are configured for removable mounting on the pair of yoke arm attachment interfaces of the pedestal for movement with the pedestal. A pair of elevation rotary bearings are respectively supported by the mounted pair of elevation yoke arms in alignment with one another to define the elevation axis. The apparatus further comprises an elevation drive motor, and an elevation drive hub connected to the elevation drive motor and supported by one of the pair of elevation rotary bearings, wherein the elevation drive hub is rotatable about the elevation axis by operation of the elevation drive motor. An elevation follower hub is supported by the other of the pair of rotary bearings. The elevation drive hub and the elevation follower hub are configured for removable mounting of a primary weapon thereto such that the primary weapon resides between the mounted pair of elevation yoke arms and is rotatable about the elevation axis by operation of the elevation drive motor.

When the first pair of elevation yoke arms are mounted on the pedestal, they support the pair of elevation rotary bearings such that the elevation axis is at a first height above the pedestal. When the second pair of elevation yoke arms are mounted on the pedestal, they support the pair of elevation rotary bearings such that the elevation axis is at a second height above the pedestal different from the first height. Consequently, the elevation axis is height-adjustable for replacing a mounted primary weapon with a different primary weapon.

In an alternative embodiment providing height adjustment of the elevation axis, the configurable weapon station apparatus comprises a pair of spacers for selective installation between a driver elevation yoke arm and a follower elevation yoke arm, respectively. Each spacer includes a bottom end configured for removable mounting on the first attachment interface of the pedestal and a top end having a yoke arm attachment interface. The respective elevation yoke arms may be directly mounted on the pedestal (i.e. without the spacers) to set the elevation axis at a first height. In an alternative configuration, the spacers may be directly mounted on the pedestal and the respective elevation yoke arms may be mounted on top of the spacers to set the elevation axis at a second height greater than the first height.

In another embodiment of the invention, a vehicle-mounted weapon station is provided with at least one fixed hanging ammunition container that is reloadable under the armored protection of the vehicle and the weapon station shell. The ammunition container has an ammunition storage portion and an ammunition exit chute leading from the storage portion, and the ammunition container is fixed to the pedestal such that the storage portion of the ammunition container resides at least mostly within, preferably completely within, an interior compartment defined by the pedestal. The exit chute of the ammunition container extends through the pedestal. A belt of linked ammunition suspended in the storage portion of the ammunition container is fed through the exit chute to supply a weapon carried by the external weapon support yoke. The fixed ammunition container is reloadable by personnel under protection of the armored vehicle and the pedestal.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
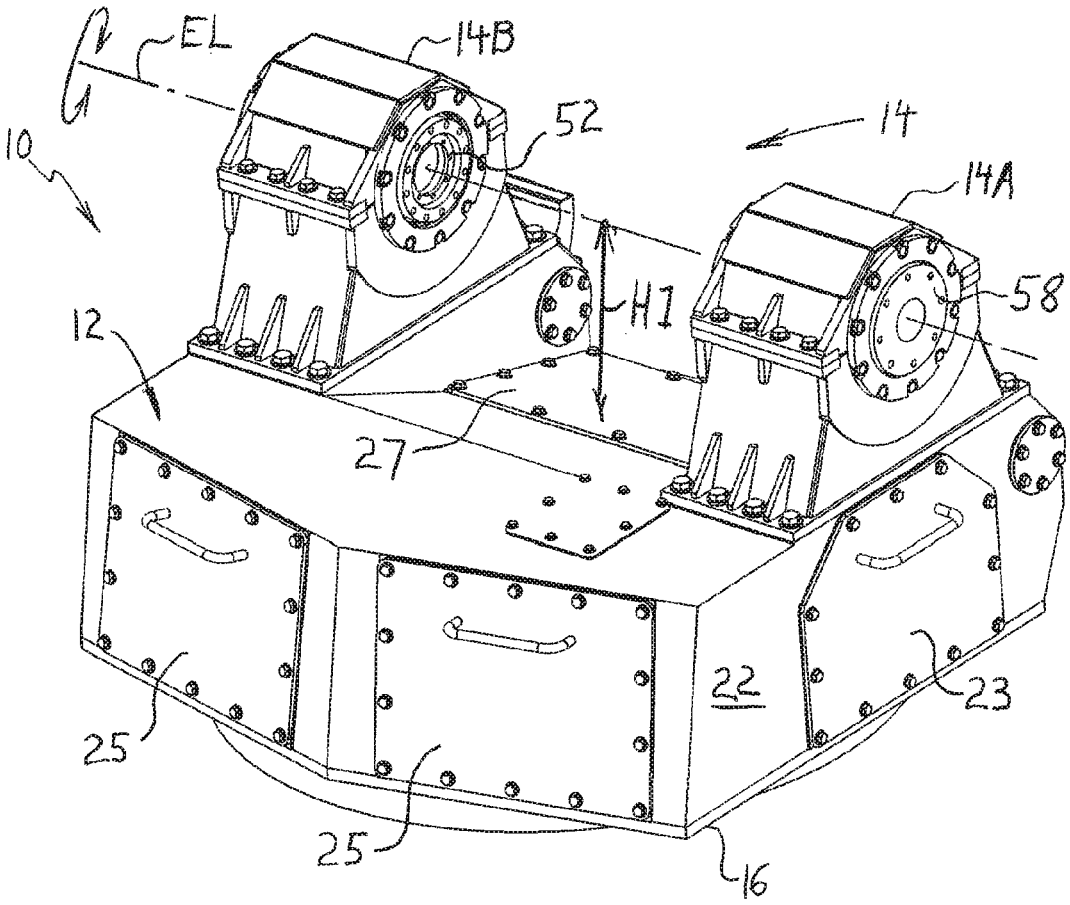
FIG. 1 is a perspective view of an RWS formed in accordance with an embodiment of the present invention, without any weapons or operational units installed thereon.
Figure 2:
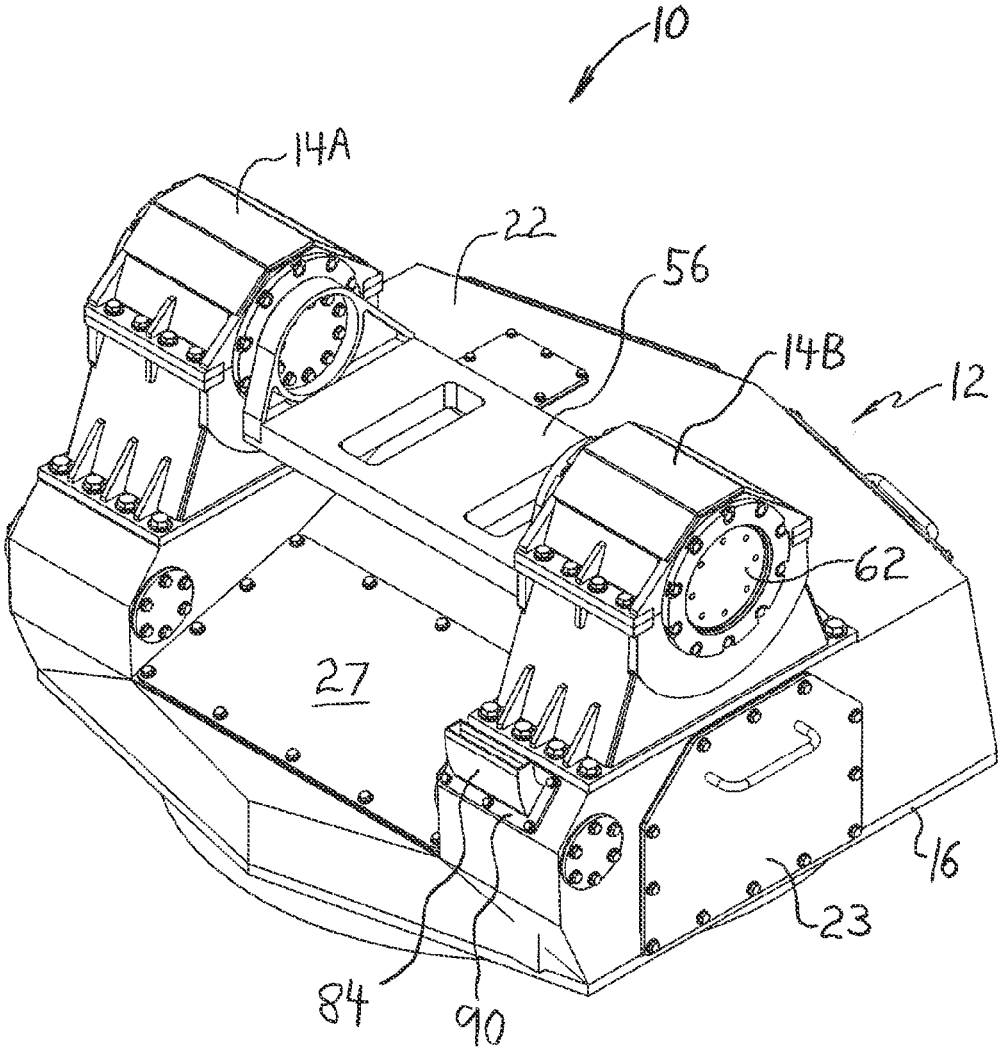
FIG. 2 is another perspective view of the RWS shown in FIG. 1, wherein the RWS is shown equipped with a central weapon cradle.
Figure 3:
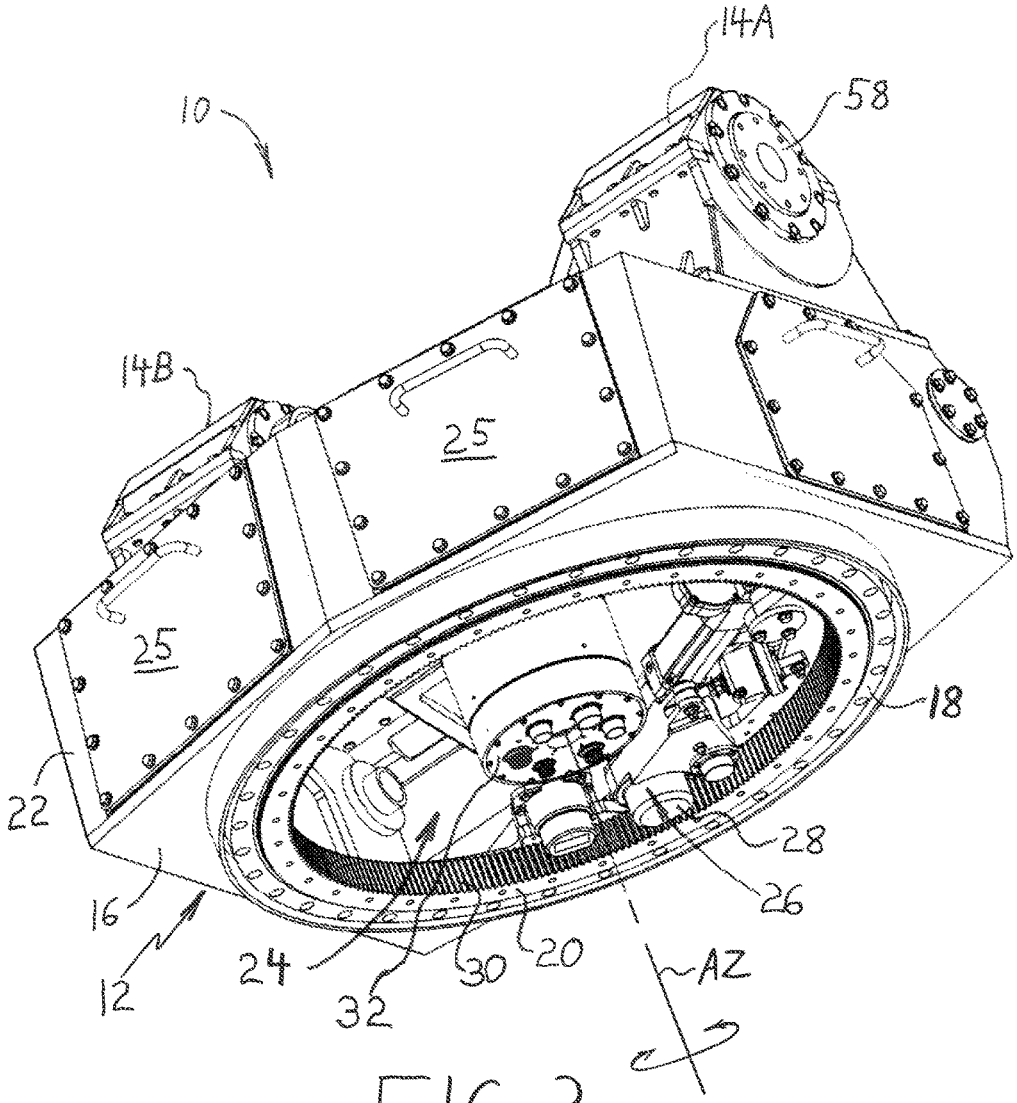
FIG. 3 is a further perspective view of the RWS shown in FIG. 1, viewing from underneath the RWS.

FIGS. 1-4 depict a remote weapon station (RWS) 10 formed in accordance with an embodiment of the present invention, wherein RWS 10 is shown without any weapons, weapon cradles, or other operational units mounted thereon. RWS 10 generally comprises a base or pedestal 12 and a weapon support yoke 14 definable by a first pair of elevation yoke arms 14A, 14B. As will be understood by those skilled in the art, pedestal 12 is adapted to be mounted on an armored vehicle (not shown) so as to cover a hatch opening in a top deck of the armored vehicle and be rotatable relative to the armored vehicle about an azimuth axis AZ. For this purpose, pedestal 12 may include a base plate 16 to which an outer rotary bearing race 18 is attached, and a corresponding inner rotary bearing race 20 mountable to the armored vehicle. For example, inner race 20 may be bolted onto the top deck of the armored vehicle. Pedestal 12 further includes an armored shell 22 coupled to base plate 16. As seen in FIG. 3, pedestal 12 defines an interior compartment 24 that is accessible from within the armored vehicle. Shell 22 may include a pair of lateral hatches 23 at opposite lateral sides of pedestal 12, a pair of front hatches 25 at a front end of the pedestal, and/or a topside hatch 27.

Rotation of pedestal 12 about azimuth axis AZ may be driven by an azimuth drive assembly 26 fixed to an interior wall of shell 22. Azimuth drive assembly 26 includes a motor-driven output gear 28 meshing with inner gear teeth 30 of inner race 20. Azimuth drive assembly 26 may be commanded through an operator interface and control electronics (not shown) to control the angular position of pedestal 12 about azimuth axis AZ relative to the armored vehicle. A slip ring assembly 32 provides signal transmission to and from azimuth drive assembly 26 and other electronic units in pedestal 12 across the rotational interface.

In accordance with an aspect of the present invention, pedestal 12 includes a pair of laterally-spaced yoke arm attachment interfaces 34 for removable mounting of elevation yoke arms 14A, 14B. In the illustrated embodiment, each yoke arm attachment interface 34 includes a flat surface 36 on the exterior of shell 22, a plurality bolt holes 38 registering with bolt holes 40 on the corresponding yoke arm 14A, 14B, and a central opening 42 communicating with pedestal interior compartment 24. The pair of elevation yoke arms 14A, 14B are removably mounted on the pair of yoke arm attachment interfaces 34 using threaded fasteners 44 extending through aligned holes 38, 40. As a result, elevation yoke arms 14A, 14B move with pedestal 12 as the pedestal rotates about azimuth axis AZ. As shown in the depicted embodiment, topside hatch 27 may be located between the pair of yoke arm attachment interfaces 34, and may be inclined relative to attachment interfaces 34 so that spent ammunition casings slide down and do not accumulate on the topside hatch. RWS 10 includes a pair of elevation rotary bearings 46A, 46B respectively supported by elevation yoke arms 14A, 14B. Elevation rotary bearings 46A, 46B are aligned with each other to define a rotational elevation axis EL at a first height H1 above pedestal 12.

Figure 5:
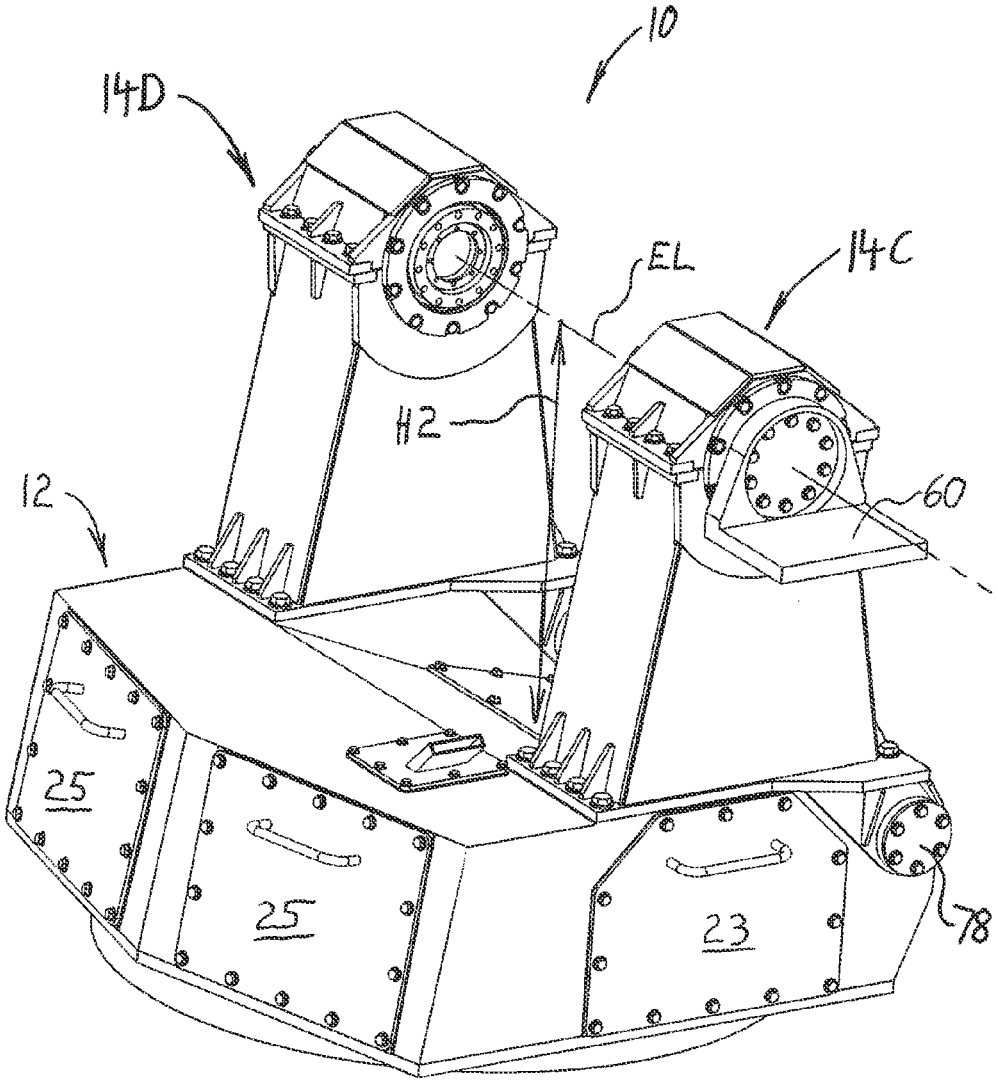
FIG. 5 is a perspective view of the RWS shown in FIG. 1, wherein a first pair of elevation yoke arms of the RWS has been replaced with a second, taller pair of yoke arms, and the RWS is shown equipped with a lateral weapon cradle.
Figure 6:
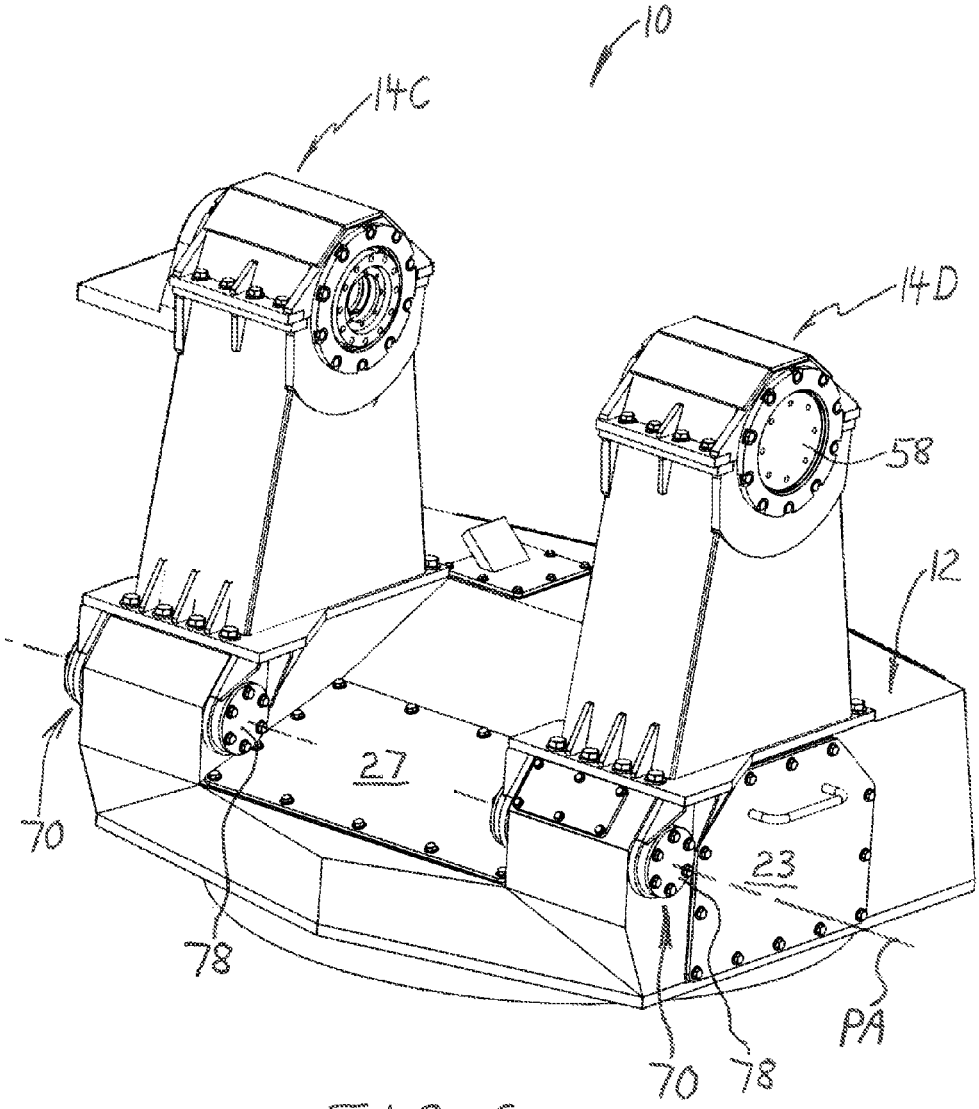
FIG. 6 is another perspective view of the RWS shown in FIG. 5.
Figure 7:
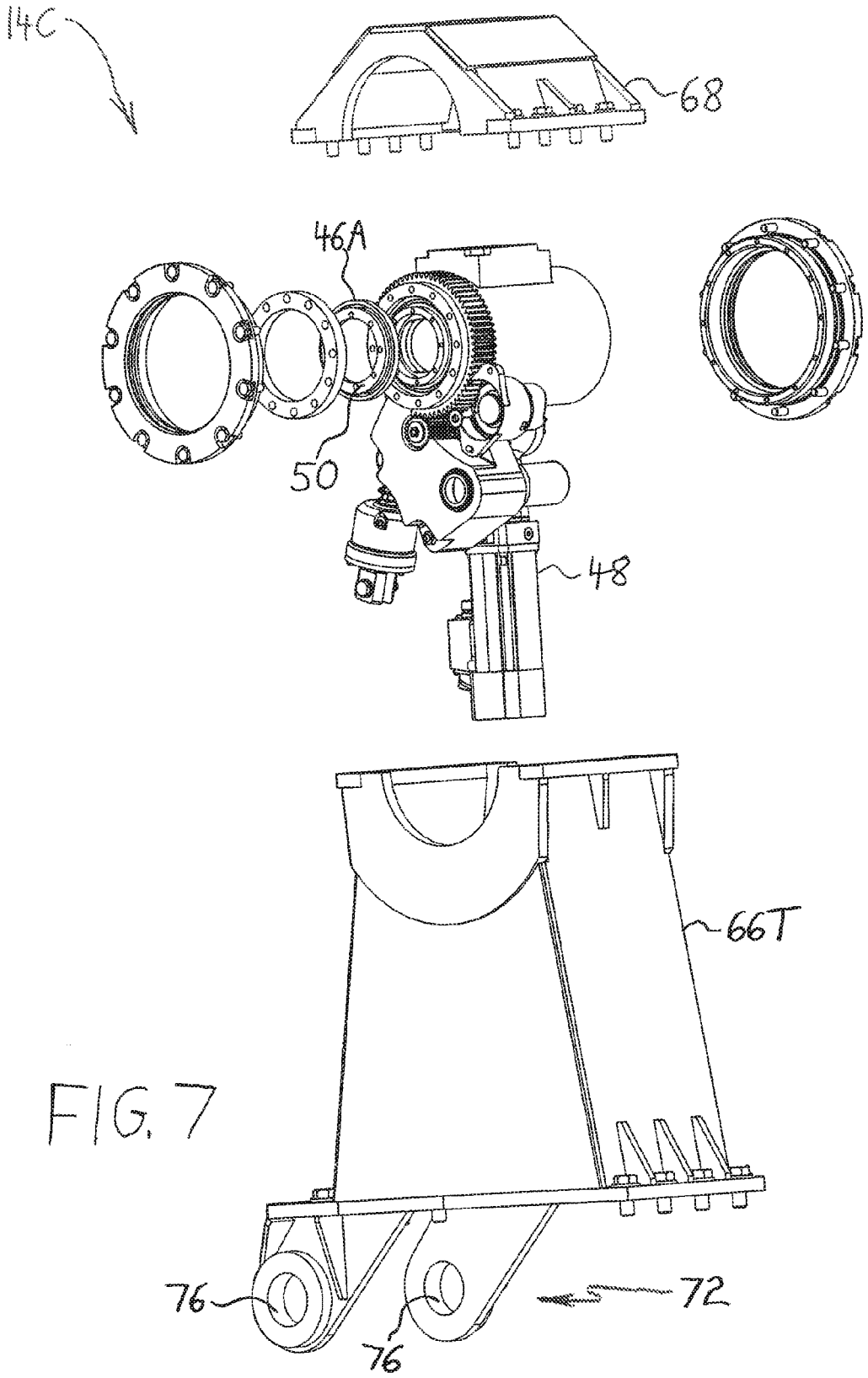
FIG. 7 is an exploded perspective view of an elevation yoke arm of the RWS shown in FIG. 5.

Reference is also made now to FIGS. 5-7. Apparatus for RWS 10 comprises a second pair of elevation yoke arms 14C, 14D configured for removable mounting on the pair of yoke arm attachment interfaces 34 of pedestal 12 for movement with the pedestal. The second pair of elevation yoke arms 14C, 14D are taller than the first pair of yoke arms 14A, 14B and can be selectively swapped with the first pair of elevation yoke arms 14A, 14B to support the pair of elevation rotary bearings 46A, 46B at a second height H2 above the pedestal greater than the first height H1. In this manner, elevation axis EL is height-adjustable for replacing a mounted primary weapon with a different primary weapon.

Figure 4:
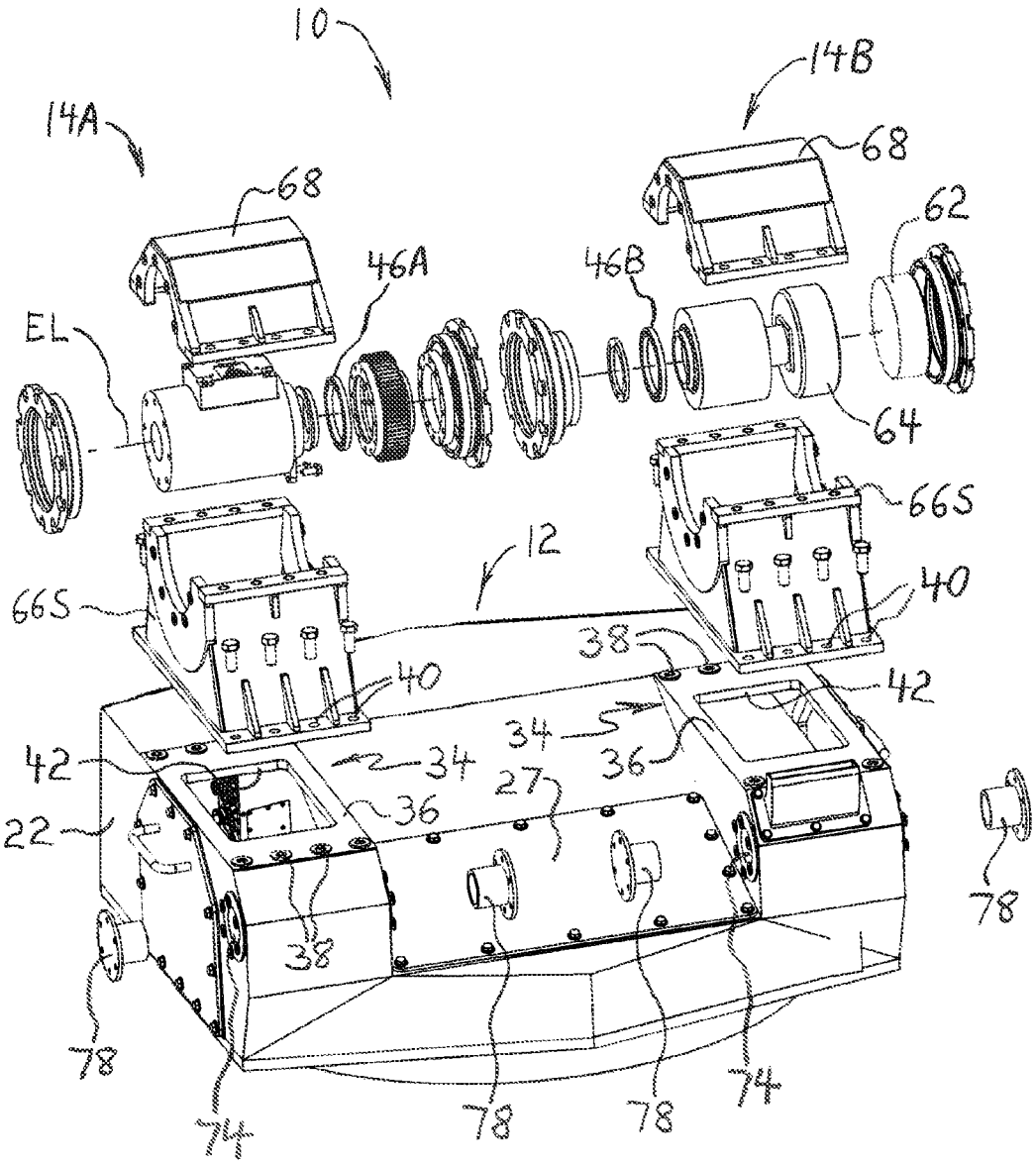
FIG. 4 is an exploded perspective view of the RWS shown in FIG. 1.

As may be understood from FIGS. 4 and 7, RWS 10 additionally comprises an elevation drive motor 48 and an elevation drive hub 50 connected to the elevation drive motor 48 and supported by elevation rotary bearing 46A, wherein elevation drive hub 50 is rotatable about elevation axis EL by operation of elevation drive motor 48. Elevation drive motor 48 may be housed within the elevation yoke arm that houses drive hub 50 to keep drive motor 48 near drive hub 50 and reduce complexity of a connecting drive train assembly, however drive motor 48 may be located outside of the yoke arm without straying from the invention.

RWS 10 also comprises an elevation follower hub 52 supported by elevation rotary bearing 46B. Elevation drive hub 50 and elevation follower hub 52 are configured for removable mounting of at least one primary weapon thereto such that the primary weapon resides between the mounted pair of elevation yoke arms 14A, 14B or 14C, 14D and is rotatable about elevation axis EL by operation elevation drive motor 48. For example, hubs 50 and 52 may each include a bolt hole array used to removably mount a weapon cradle 56 (shown in FIG. 2) or to directly mount a primary weapon housing thereto. Weapon cradle 56 may be designed to support more than one weapon.

RWS 10 may further comprise a lateral hub 58 connected to elevation drive motor 48, wherein the lateral hub 58 is rotatable about elevation axis EL by operation of elevation drive motor 48. Lateral hub 58 is configured for removable mounting of a secondary weapon thereto, either directly or through a secondary or lateral weapon cradle 60, such that the mounted secondary weapon is rotatable about elevation axis EL by operation of the elevation drive motor 48.

Referring again to FIG. 4, RWS 10 may also comprise a sighting hub 62 and a corresponding sighting drive motor 64. In the embodiment shown, sighting hub 62 is supported by the same yoke arm (either 14 B or 14D) as elevation follower hub 52 for rotation about elevation axis EL. Sighting hub 62 is configured for removable mounting of a sighting unit thereto. Sighting hub 62 is rotatable about elevation axis EL by operation of sighting drive motor 64. Sighting drive motor 64 is operable independently of elevation drive motor 48, whereby sighting hub 62 and a mounted sighting unit are rotatable about the elevation axis EL independently of elevation drive hub 50 and any equipment or weapons mounted to drive hub 50.

Attention is now directed to FIGS. 4 and 7. In an aspect of the present invention, the second pair of elevation yoke arms 14C, 14D may be structurally similar to the first pair of elevation yoke arms 14A, 14B. When mounted to pedestal 12, each yoke arm 14A-14D includes a respective base 66S or 66T and a respective cap 68 removably attachable onto base 66. In the embodiment shown by the figures, the yoke arm bases 66T (tall) of the second pair of elevation yoke arms 14C, 14D are taller than the yoke arm bases 66S (short) of the first pair of elevation yoke arms 14A, 14B. Each base 66S or 66T is adapted for removable mounting to one of the yoke arm attachment interfaces 34 of pedestal 12. For example, each yoke arm base 66S or 66T may include bolt holes 40 registering with the bolt holes 38 of an associated yoke arm attachment interface 34. Caps 68 for yoke arms 14C, 14D may be identical to caps 68 for yoke arms 14A, 14B, or at least they may fit onto yoke arms 14A, 14B. Thus, the overall apparatus may require only a single pair of caps 68 for installation on the two bases 66 of the particular pair of yoke arms that currently mounted on pedestal 12 at a given time; the yoke arm bases 66S or 66T not in use at a given time do not require caps 68.

When RWS 10 is configured with taller yoke arms 14C, 14D, the overall height of the armored vehicle may prevent it from passing through locations where there are overhead obstructions. In order to temporarily lower the overall profile height of the armored vehicle, pedestal 12 may further include a pair of yoke arm pivot interfaces 70 spaced from the pair of yoke arm attachment interfaces 34, and the yoke arm bases 66T of the second pair of yoke arms 14C, 14D may include a pivot coupling 72 configured to mate with a corresponding pivot interface 70 of pedestal 12. For example, pivot interfaces 70 may have a pair of aligned circular pivot apertures 74 with which another pair of pivot apertures 76 in base 66T may be aligned, and a pair of pivot covers 78 securable into the aligned pivot apertures 74, 76. As a result, the second pair of yoke arms 14C, 14D may be pivoted relative to pedestal 12 when they are situated on, but not fixed to, yoke arm attachment interfaces 34. In this way, the armored vehicle can be provided with a lower profile for travel. The yoke arm pivot interfaces 70 may define a yoke arm pivot axis PA parallel to and behind elevation axis EL.

Changeover between the first pair of yoke arms 14A, 14B and the second pair of yoke arms 14C, 14D may be carried out by unbolting yoke arm caps 68 from the mounted yoke arm bases, removing the assembled bearings, hubs, and any drive motors housed by the mounted yoke arms, and unbolting the mounted yoke arm bases 66 from yoke arm attachment interfaces 34. The yoke arm bases 66 of the other pair of yoke arms are then bolted to the yoke arm attachment interfaces 34, the drive assemblies are reinstalled and aligned in the newly mounted yoke arm bases 66, and the caps 68 are bolted onto the newly mounted yoke arm bases 66. Transferring the same drive assemblies and bearings between the short and tall yoke arms avoids hardware cost and reduces the amount of additional hardware that must be stocked. It is also contemplated to provide dedicated drive assemblies within each yoke arm 14A-14D so that removal and replacement of the drive assemblies is not necessary. As will be appreciated, changeover may be accomplished quickly by trained mechanics at a military base, whereby the same armored vehicle may have one RWS configuration one day and a different RWS configuration the next.

Figure 8:
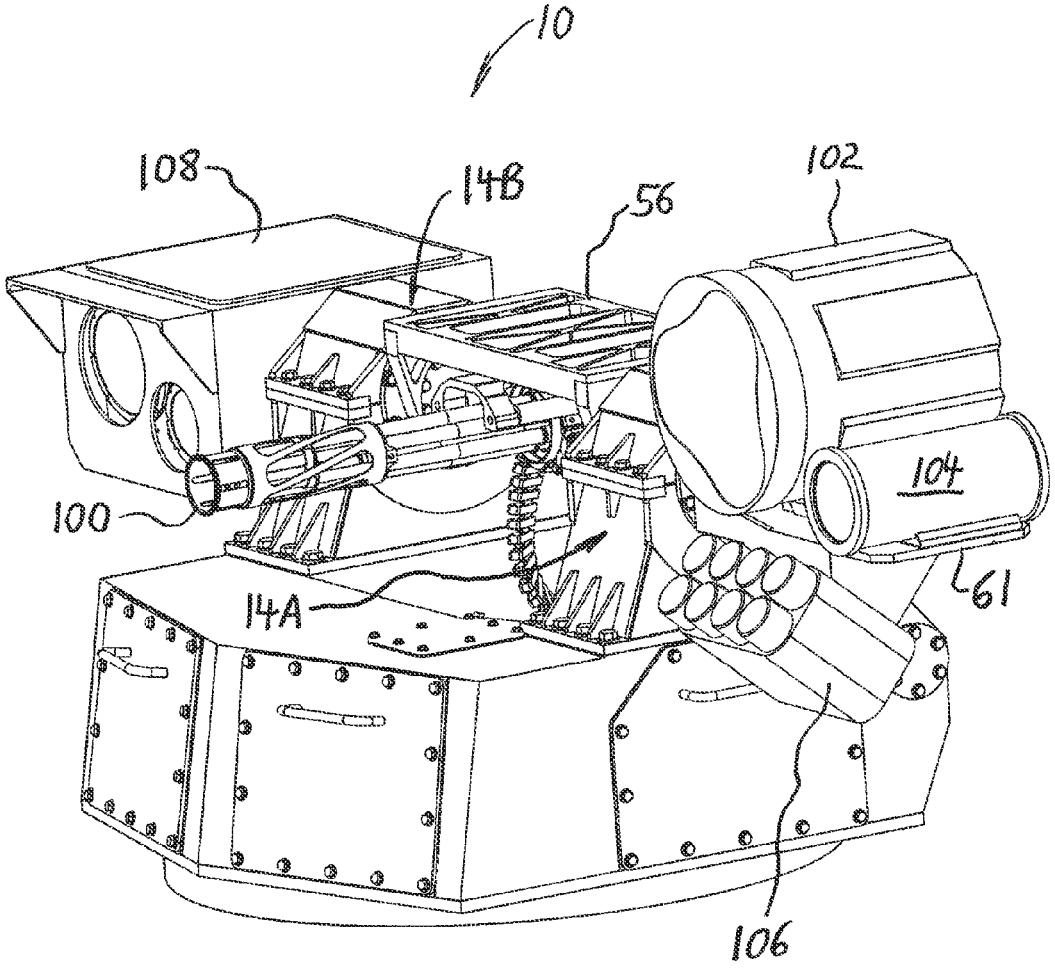
FIGS. 8-10 depict examples of various weapon configurations of the RWS as shown in FIG. 1, wherein shorter yoke arms are installed.
Figure 9:
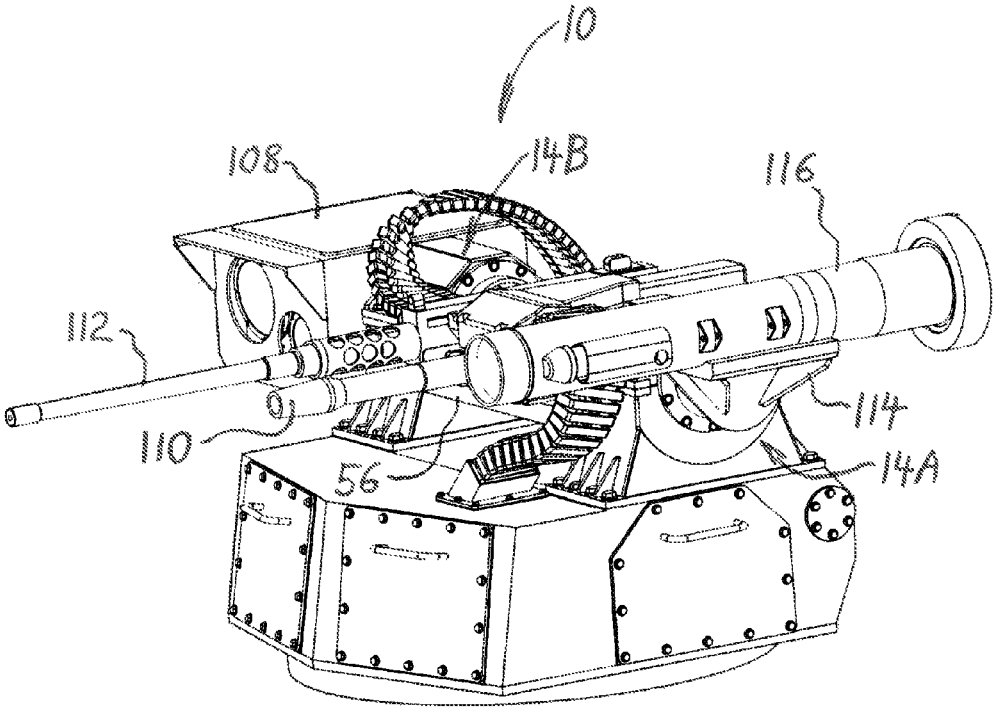
Figure 10:
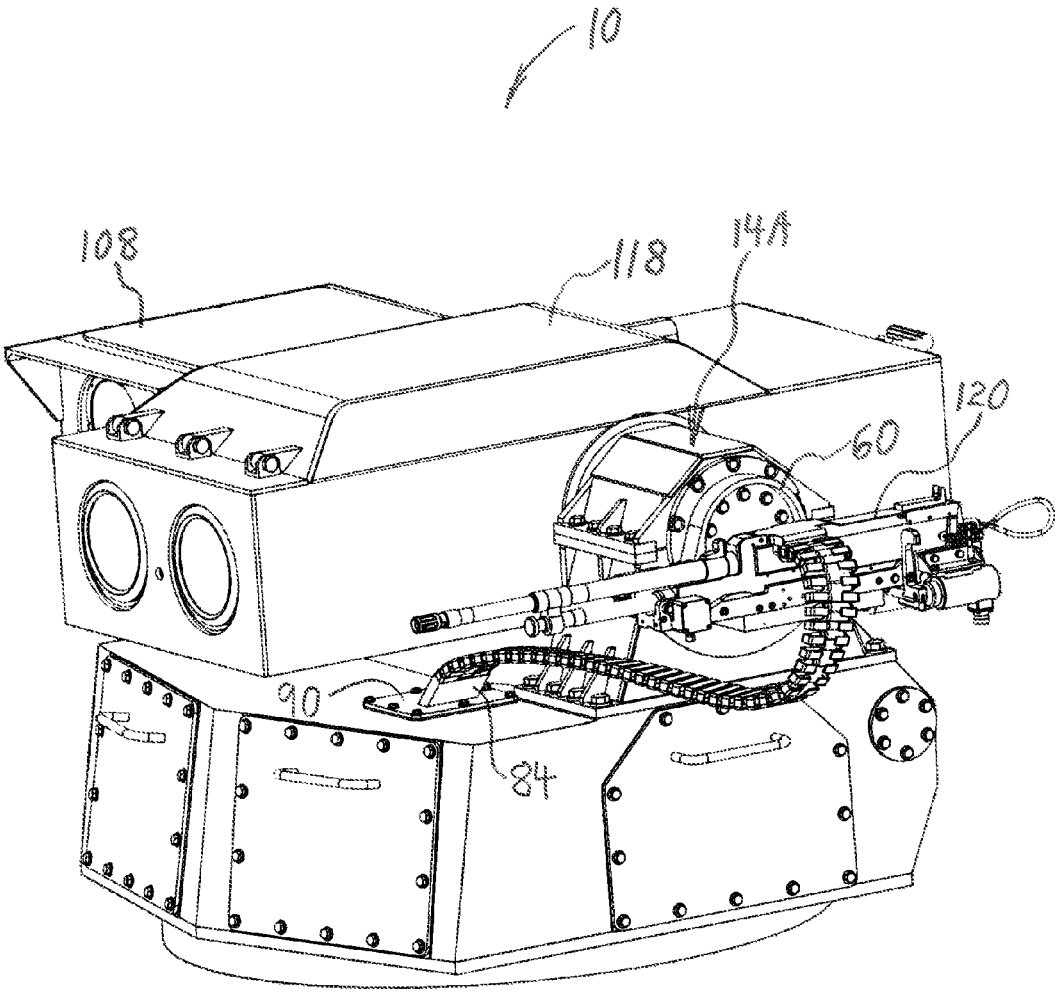

FIGS. 8-10 illustrate various examples of weapon configurations of RWS 10 when the shorter pair of yoke arms 14A, 14B is installed on pedestal 12.

In FIG. 8, there is central weapon cradle 56 mounted between drive hub 50 and follower hub 52, and an M134 machine gun 100 mounted on central weapon cradle 56 as a primary weapon. A non-lethal equipment cradle 61 is coupled to lateral hub 58 and carries an acoustic hailer 102, an illuminator 104, and a grenade launcher 106. A sighting unit 108 is mounted on the opposite side of the RWS to sighting hub 62.

The configuration shown in FIG. 9 includes central weapon cradle 56 mounted between drive hub 50 and follower hub 52 to support an MK19 automatic grenade launcher 110 and an M2 machine gun 112. A javelin mount 114 is attached to lateral hub 58 and supports a javelin missile launcher 116. Sighting unit 108 is mounted on sighting hub 62.

Figure 34:
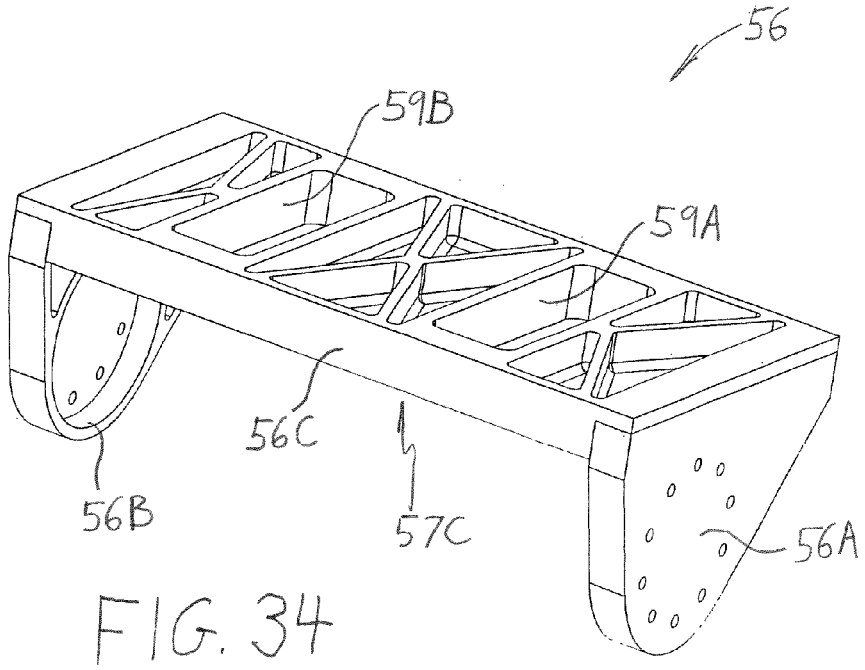
FIG. 34 is a perspective view of the weapon support cradle shown in FIG. 33, wherein the cradle is shown in its inverted orientation.
Figure 35:
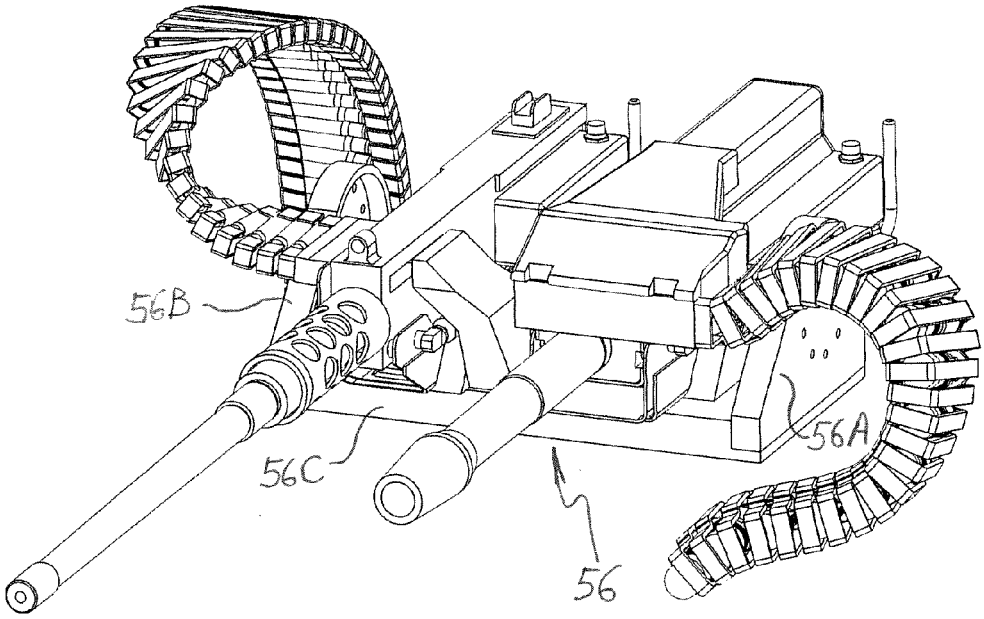
FIG. 35 is a view similar to that of FIG. 33, wherein the non-inverted cradle is shown supporting weaponry seated upon a platform of the cradle.
Figure 36:
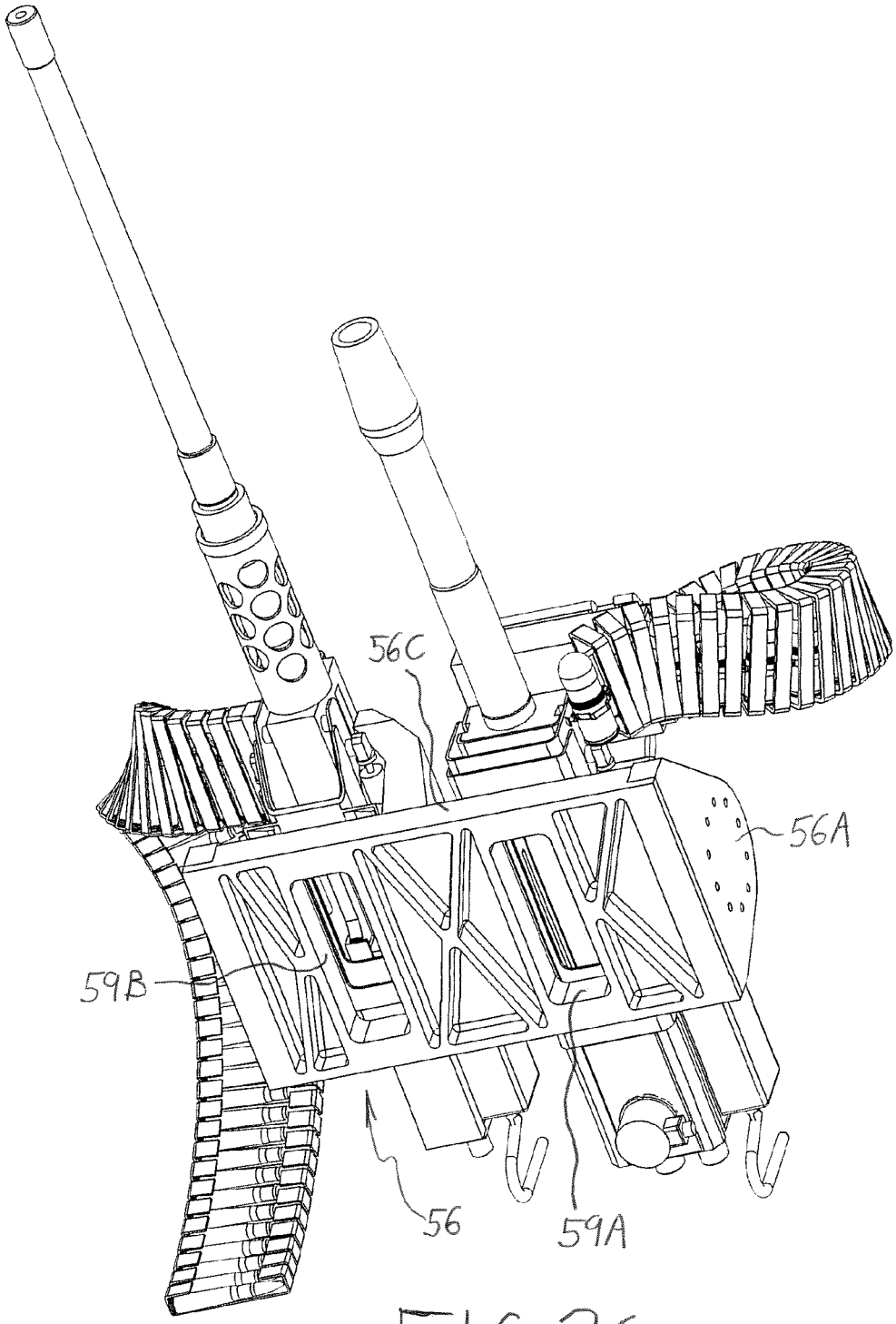
FIG. 36 is perspective view of the weapon support cradle and weaponry shown in FIG. D3 as viewed from underneath the weapon support cradle.
Figure 37:
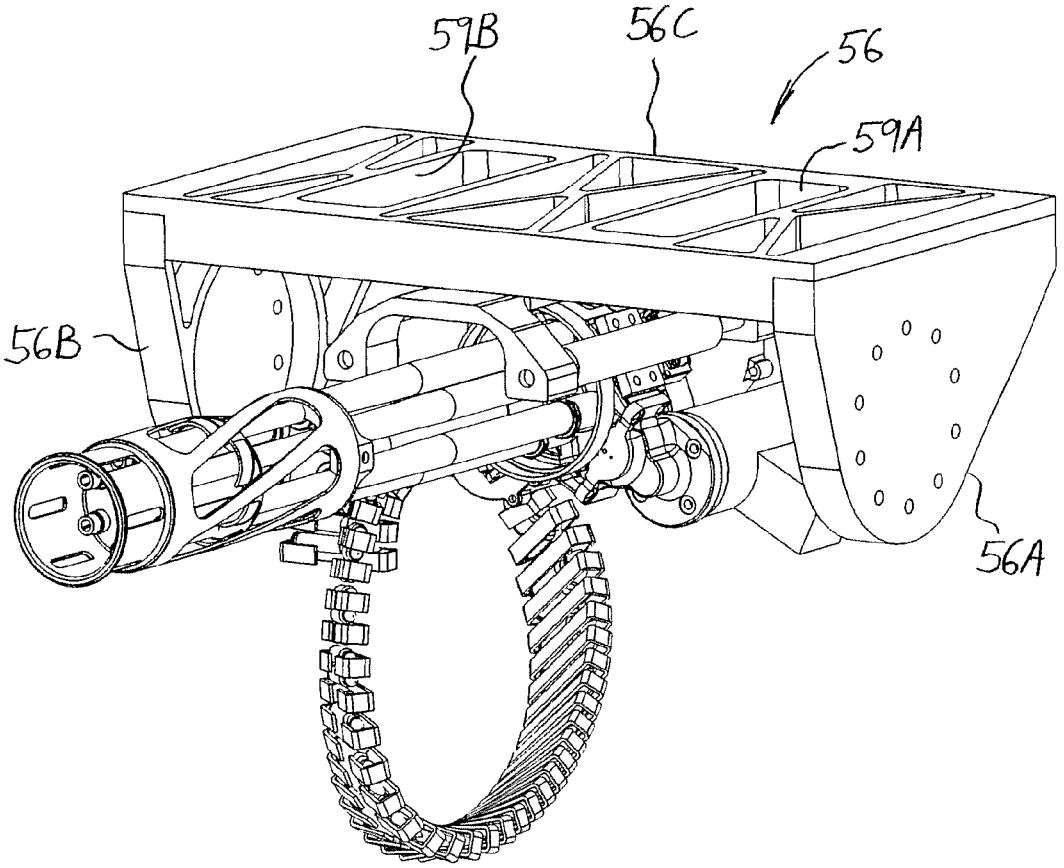
FIG. 37 is a view similar to that of FIG. 34, wherein the inverted cradle is shown supporting weaponry suspended from the cradle platform.

As may be understood from FIGS. 8-9 and FIGS. 33-37, central weapon cradle 56 may be mounted to drive hub 50 and follower hub 52 in a non-inverted orientation (see FIGS. 9, 33, 35, and 36) and in an inverted orientation (see FIGS. 8, 34, and 37). Invertible cradle 56 comprises a pair of laterally-spaced mounting braces 56A, 56B configured for respective removable attachment to hubs 50, 52, and a support platform 56C extending between the pair of mounting braces 56A, 56B. Support platform 56C extends in a plane parallel to and offset from elevation axis EL. In the embodiment shown, support platform 56C includes a first under-weapon mounting area 57A upon which a weapon may be seated when cradle 56 is mounted in its non-inverted orientation, wherein the first under-weapon mounting area has an access opening 59A. Support platform 56C may further include a second under-weapon mounting area 57B upon which another weapon may be seated when cradle 56 is mounted in its non-inverted orientation, wherein the second under-weapon mounting area 57B has a corresponding access opening 59B. Access openings 59A and 59B are positioned and sized to allow spent ammunition casings to drop down away from the weapon mounted above. Support platform 56C also includes an over-weapon mounting area 57C from which a weapon may be suspended. In the embodiment shown, over-weapon mounting area 57C is between access openings 59A, 59B. When cradle 56 is mounted to hubs 50, 52 in its non-inverted orientation, the plane of support platform 56C is below elevation axis EL for seating a weapon in the first under-weapon mounting area 57A and/or in the second under-weapon mounting area 57B. When cradle 56 is mounted to hubs 50, 52 in its inverted orientation, the plane of support platform 56C is above elevation axis EL for suspending a weapon from the over-weapon mounting area 57C.

In FIG. 10, a TOW missile launcher 118 has a hub bracket for direct mounting to drive hub 50 and follower hub 52. Lateral cradle 60 supports an M240 machine gun 120. Sighting unit 108 is mounted on sighting hub 62.

FIGS. 11-14 show examples of other weapon configurations of RWS 10 when the taller pair of yoke arms 14C, 14D is installed on pedestal 12 replacing shorter yoke arms 14A, 14B.

Figure 11:
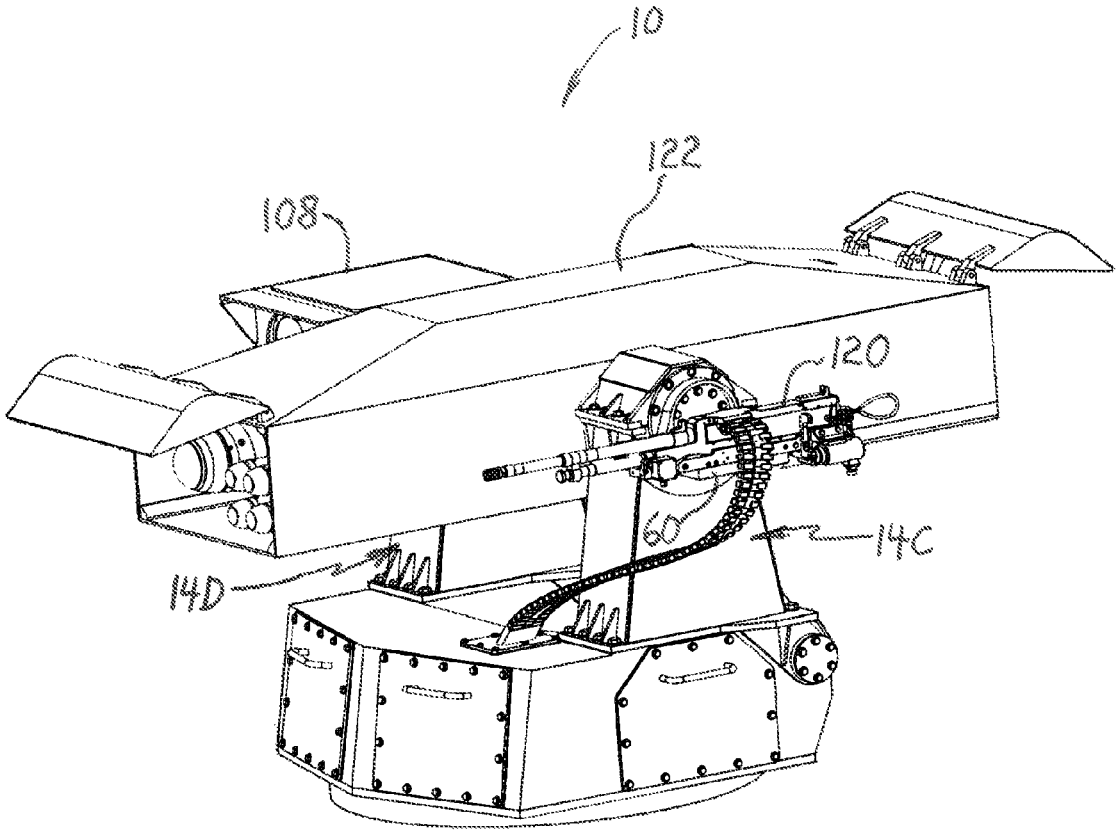
FIGS. 11-14 depict examples of various weapon configurations of the RWS as shown in FIG. 5, wherein taller yoke arms are installed.

In FIG. 11, a hellfire missile launch pod 122 has a hub bracket for direct mounting to drive hub 50 and follower hub 52. Lateral cradle 60 supports M240 machine gun 120. Again, sighting unit 108 is mounted on sighting hub 62.

Figure 12:
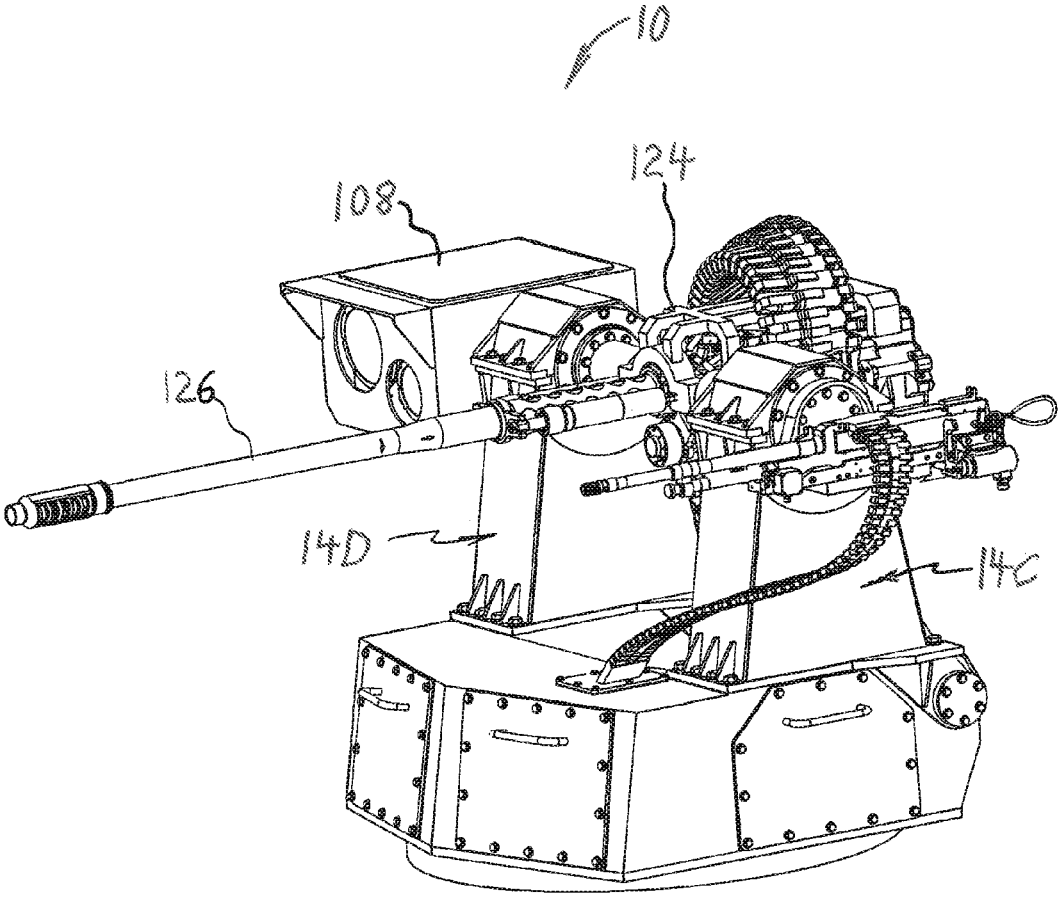

The configuration of FIG. 12 is similar to that of FIG. 11, except the hellfire pod is replaced by an M230LF cradle 124 coupled to hubs 50 and 52 that carries an M230LF autocannon 126.

Figure 13:
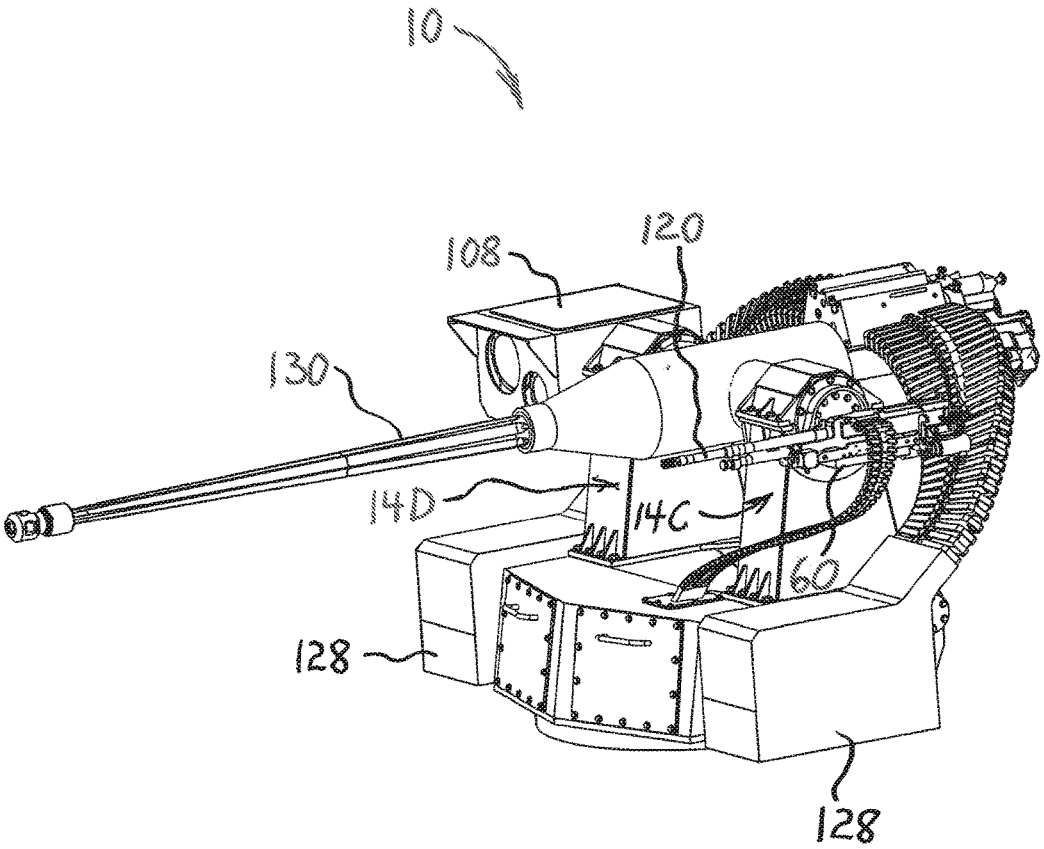

In FIG. 13, a pair of 30 mm ammunition boxes 128 are associated with opposite lateral sides of RWS 10, and an MK44 chain gun assembly 130 is mounted to hubs 50 and 52 as the primary weapon. Lateral cradle 60 supports M240 machine gun 120, and sighting unit 108 is mounted on sighting hub 62.

Figure 14:
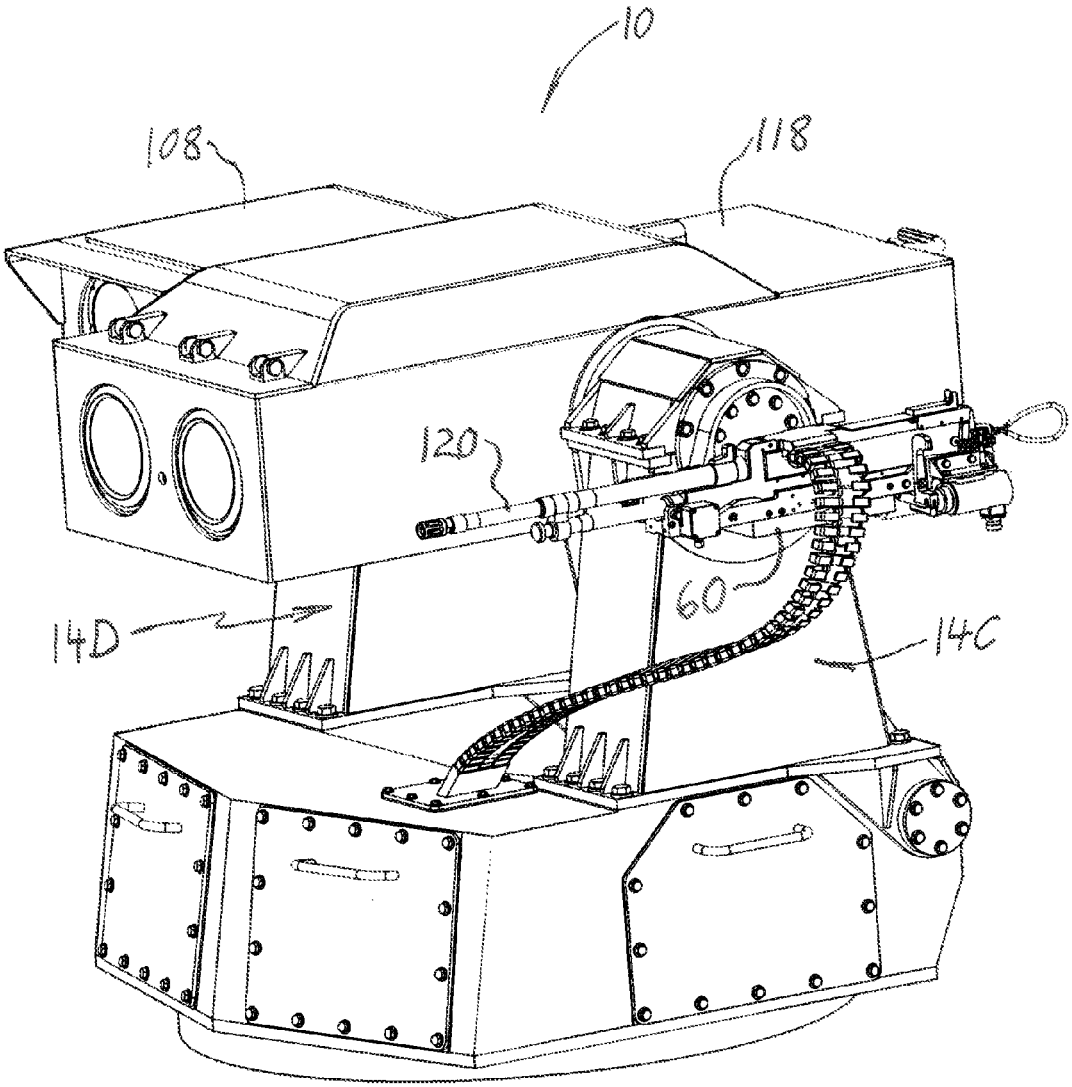
Figure 15:
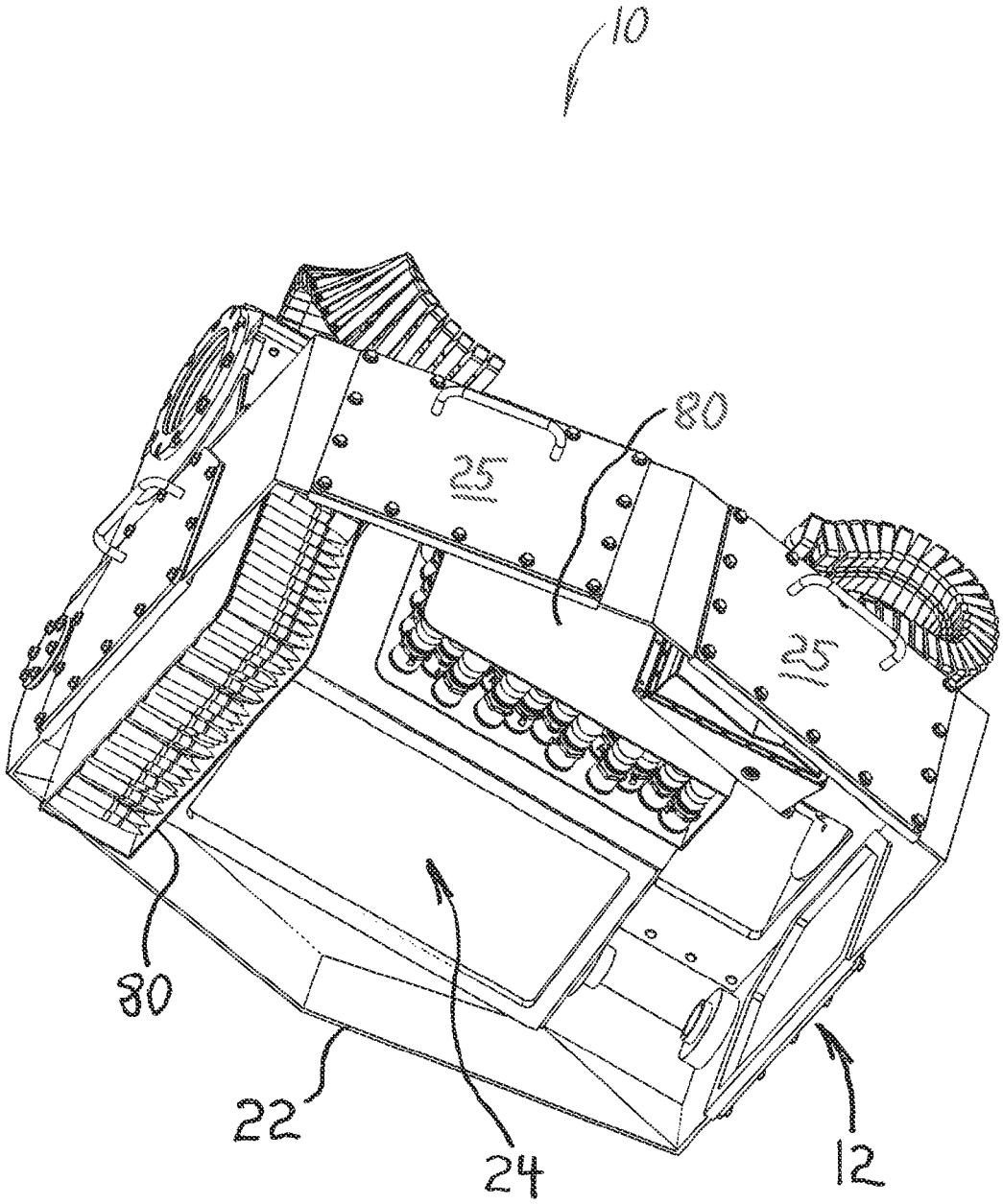
FIG. 15 is a perspective view looking upward toward an inner compartment of the RWS pedestal, wherein a base plate of the pedestal and other structure are hidden to more clearly show ammunition containers of the RWS.
Figure 16:
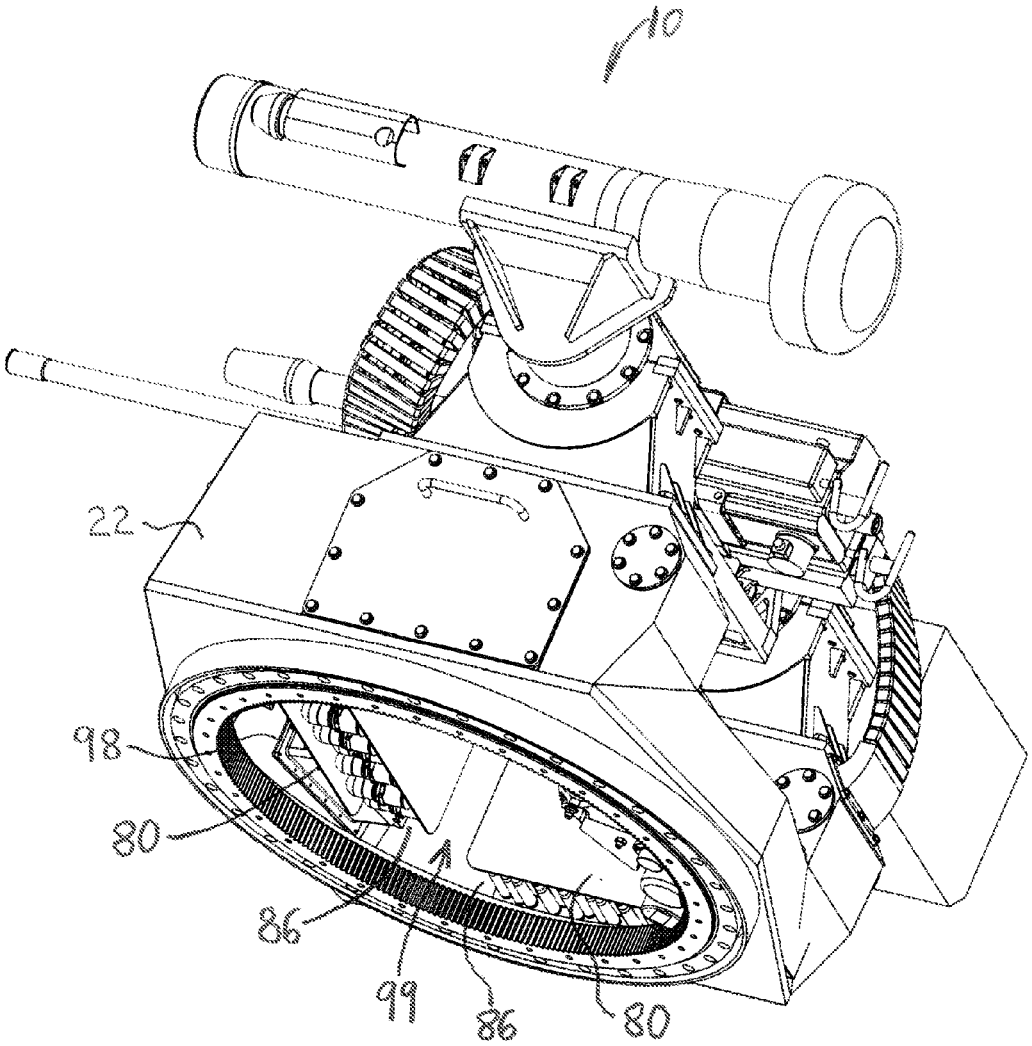
FIG. 16 is another perspective view looking upward toward an inner compartment of the RWS pedestal, wherein a slip ring of the RWS is hidden to more clearly show ammunition containers of the RWS.
Figure 17:
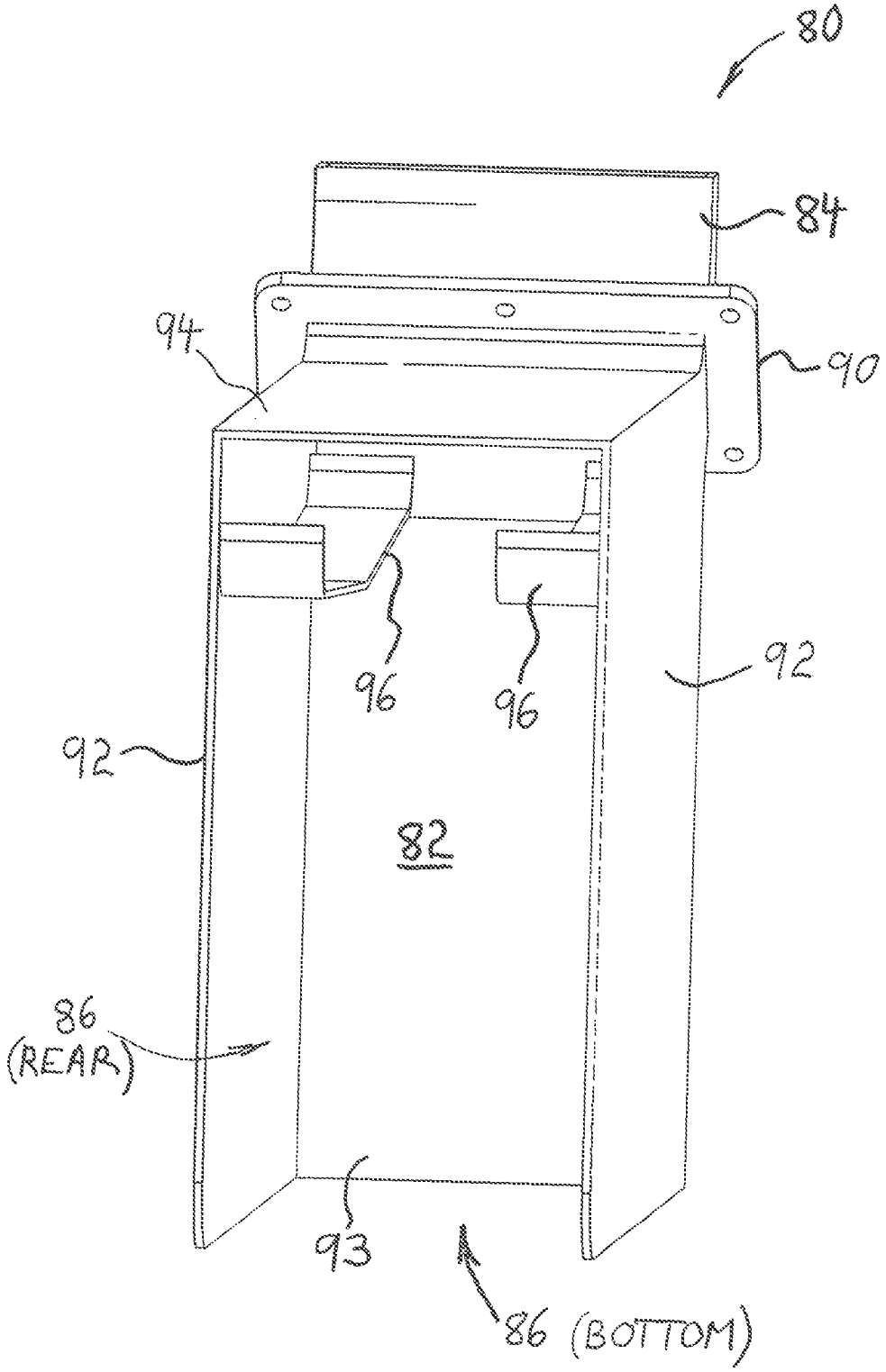
FIG. 17 is a perspective view of an empty ammunition container of the RWS.

FIG. 14 shows TOW missile launcher 118 directly mounted to hubs 50 and 52 as the primary weapon. Lateral cradle 60 supports M240 machine gun 120, and sighting unit 108 is mounted on sighting hub 62.

The configurations shown in FIGS. 8 through 14 are intended as non-limiting examples. Of course, many other configurations involving other weapons and equipment are possible.

In another aspect of the present invention, RWS 10 enables reloading of ammunition under the armored protection of the vehicle and pedestal 12 without using space within the vehicle compartment and without the need for a conveyor mechanism. As best seen in FIGS. 15-18, RWS 10 comprises an ammunition container 80 having an ammunition storage portion 82 and an ammunition exit chute 84 leading from the storage portion 82, wherein the ammunition container 80 is fixed to pedestal 12 such that its storage portion 82 resides completely within interior compartment 24 of pedestal 12 and its exit chute 84 extends through shell 22 of pedestal 12. While it is preferred that storage portion 82 fit completely within interior compartment 24, an alternative wherein storage portion 82 is mostly within interior compartment 24 is also contemplated. Storage portion 82 of ammunition container 80 has a reload opening 86 by which the ammunition container may be reloaded with ammunition. A belt 88 of linked ammunition is fed from storage portion 82 through exit chute 84 to supply a weapon carried by the weapon support yoke 14, and the ammunition container is reloadable by onboard personnel under protection of the armored vehicle and the pedestal.

Ammunition container 80 may include a flange 90 on exit chute 84, whereby the ammunition container 80 may be fixed to shell 22 of pedestal 12 by threaded fasteners engaging the flange and the pedestal.

Figure 18:
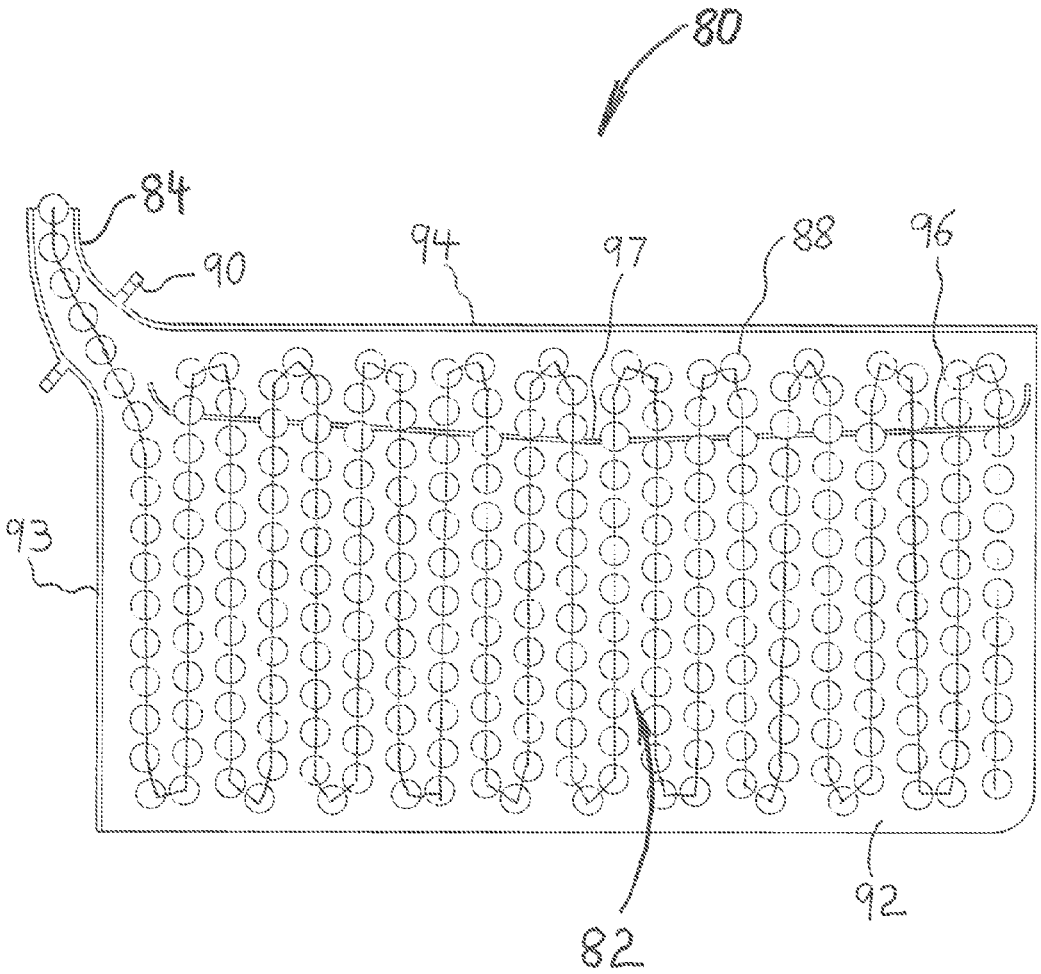
FIG. 18 is a cross-sectional view of the ammunition container shown in FIG. 17, wherein the ammunition container is loaded with an ammunition belt.

The storage portion 82 of ammunition container 80 may have a pair of side walls 92 connected by a front wall 93 and a top wall 94, wherein at least one of a bottom and a rear of storage portion 82 is open to provide the reload opening 86. Ammunition container 80 may take the form of a "hanging ammo" container configured with an open rear and a pair of inner support ledges 96 extending from side walls 92 to receive and suspend a folded ammunition belt 88 that is slid into the container through the rear reload opening 86. In the depicted embodiment, both the bottom and the rear of storage portion 82 are open to provide the reload opening 86, thereby allowing greater access during reloading. As best seen in FIG. 18, ledges 96 may have a slight dip or trough 97 to prevent unwanted sliding or shifting of the suspended ammunition belt 88 as the vehicle travels over uneven terrain. Support ledges 96 may be omitted if they would impede the feeding of a particular size of ammunition round.

As will be understood from the drawing figures, weapon support yoke 14 may be configured to support two weapons and RWS may comprise two ammunition containers 80 respectively associated with the two weapons. Those skilled in the art will understand that the dimensions and specific configuration of each ammunition container 80 may vary and will depend on the specific type of ammunition being fed. To allow an operator to reload either or both of the containers 80 from the same location, and to simplify location of a firing control unit 98 sensing ammunition status, the respective reload openings 86 of the two ammunition containers 80 may face a common reloading space 99 within interior compartment 24.

Figure 19:
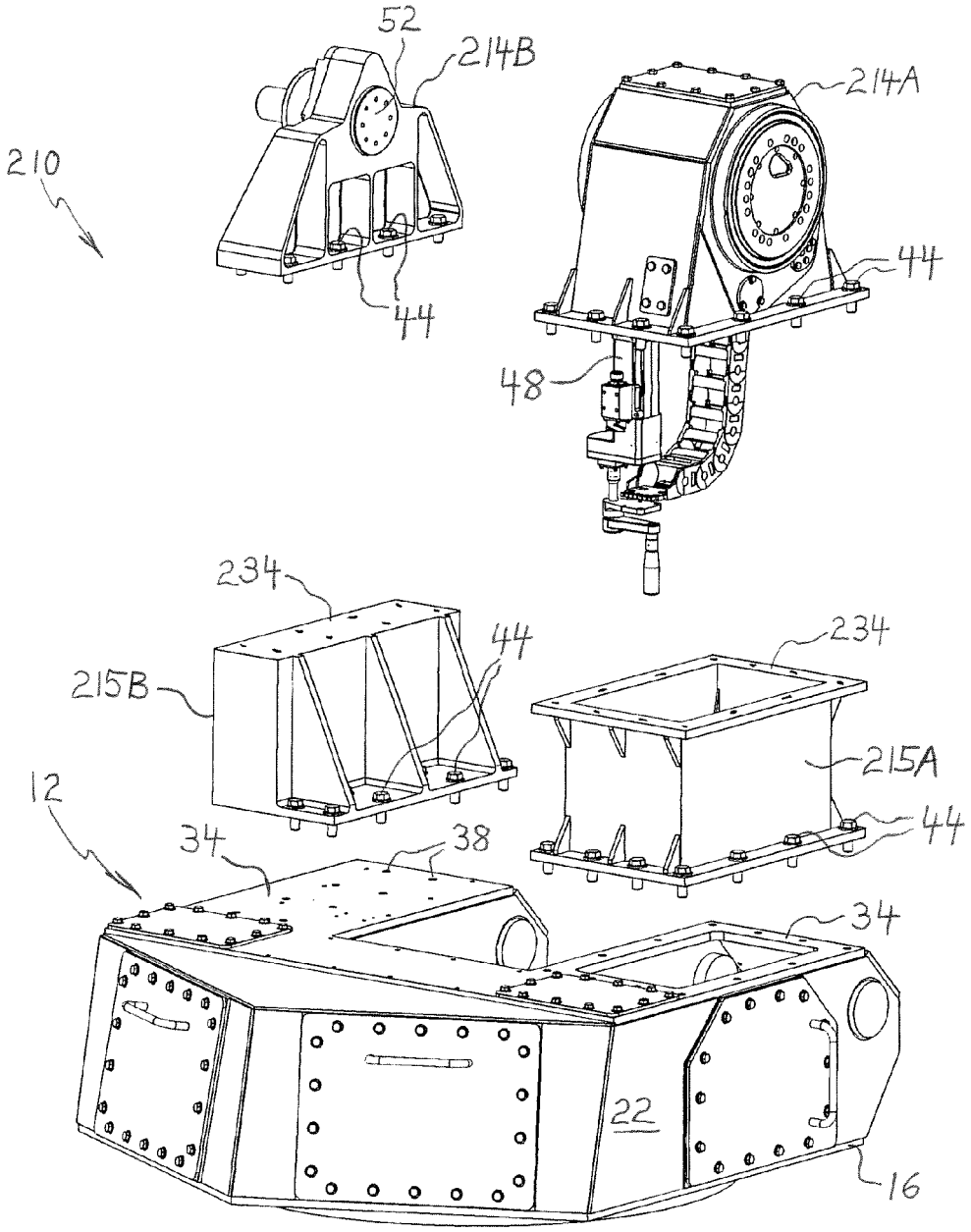
FIG. 19 is an exploded perspective view of an RWS formed in accordance with another embodiment of the present invention, without any weapons or operational units installed thereon.
Figure 20:
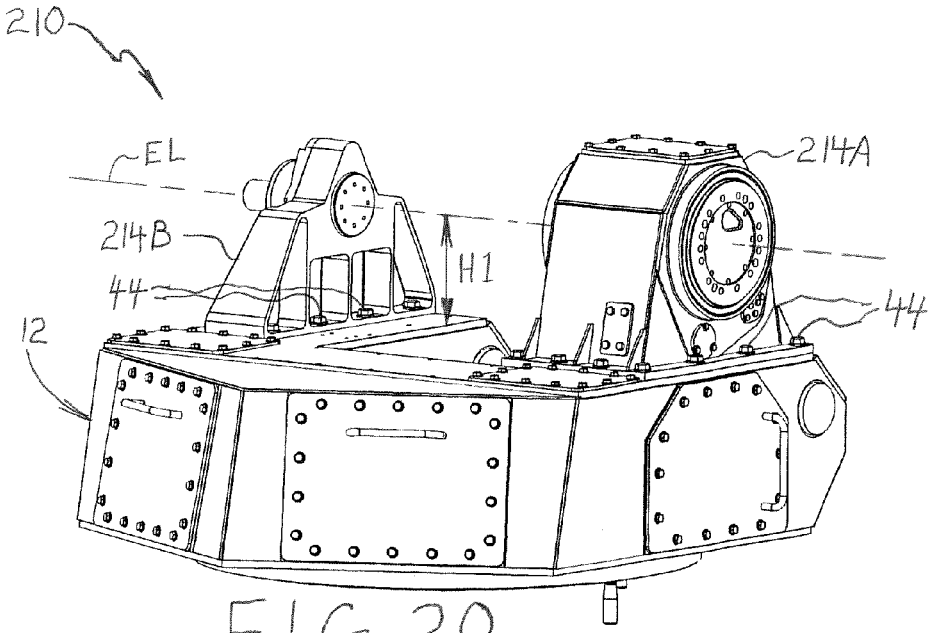
FIG. 20 is a perspective view of the RWS shown in FIG. 19 in a short configuration thereof.
Figure 21:
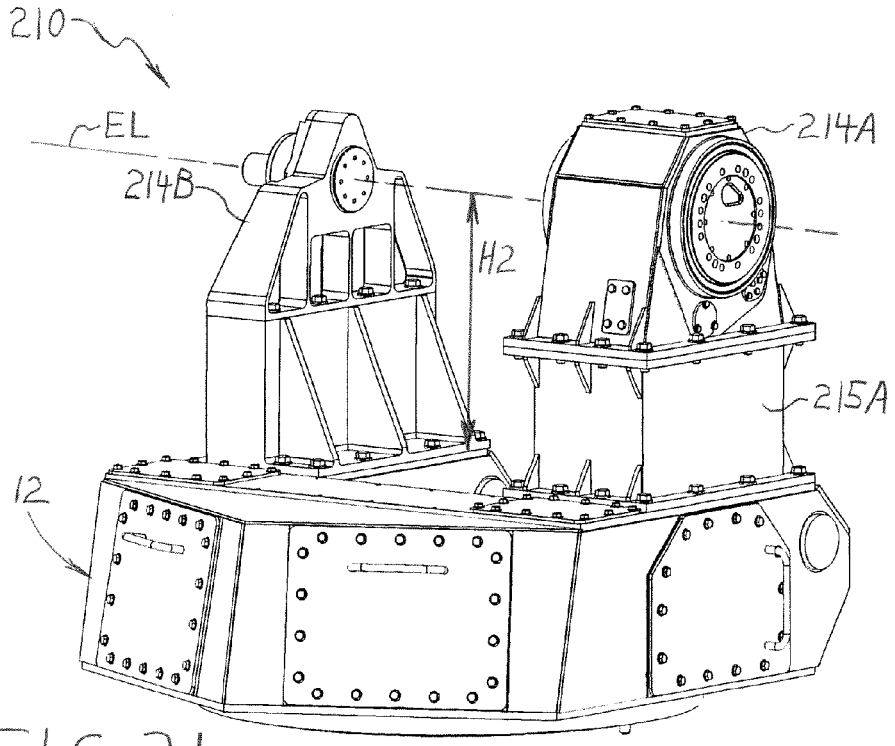
FIG. 21 is a perspective view of the RWS shown in FIG. 19 in a tall configuration thereof.
Figure 22:
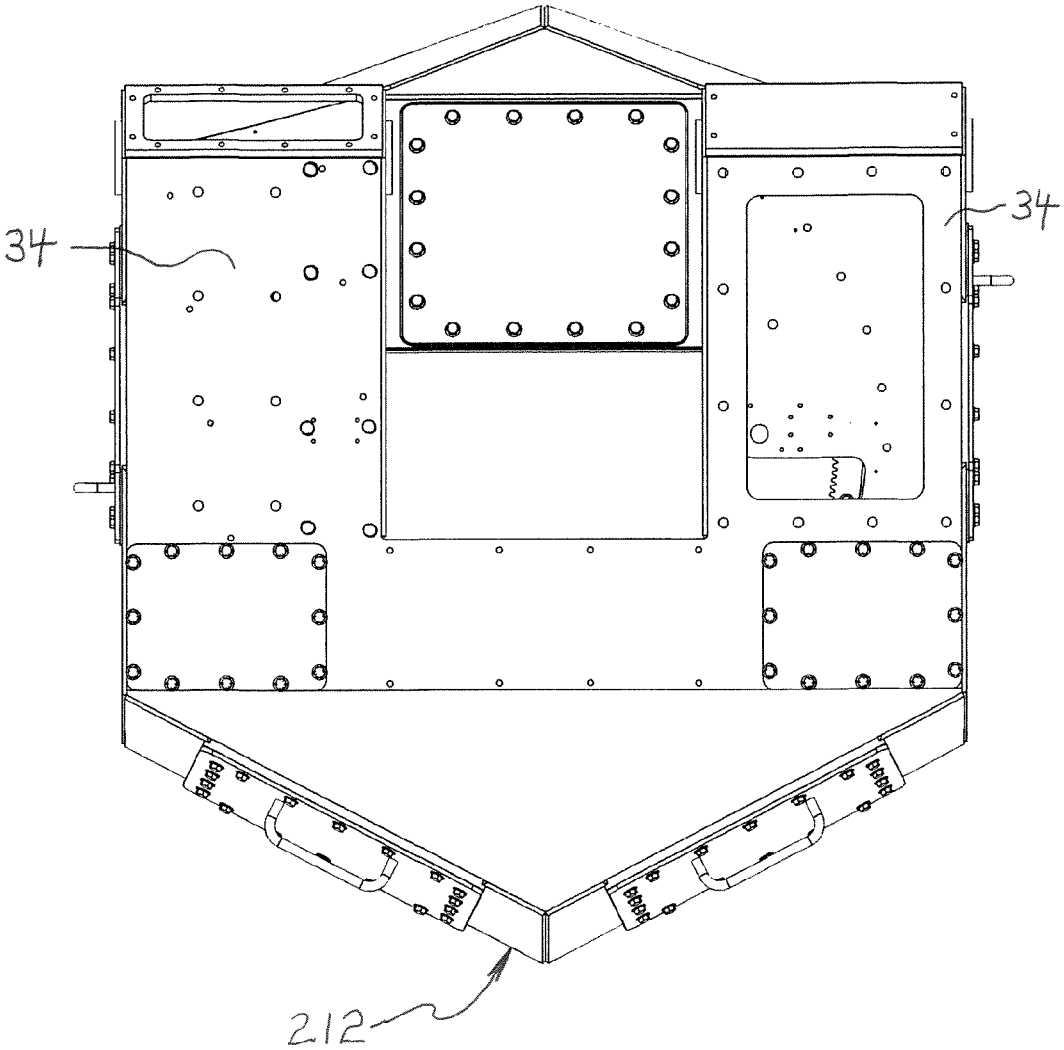
FIG. 22 is a top plan view of a pedestal of the RWS shown in FIG. 19.

FIGS. 19-24 illustrate an RWS 210 formed in accordance with another embodiment of the present invention. In FIGS. 19-21, RWS 210 is shown without any weapons, weapon cradles, or other operational units mounted thereon. RWS 210 is similar to RWS 10 described above in that it comprises pedestal 12 including base plate 16, outer rotary bearing race 18, inner rotary bearing race 20, armored shell 22, and yoke arm attachment interfaces 34. As in the previous embodiment, pedestal 12 defines interior compartment 24 that is accessible from within the armored vehicle. RWS 210 may also comprise motorized elevation and azimuth drive systems as described above in connection with RWS 10. RWS 210 further comprises a pair of elevation yoke arms 214A, 214B supporting respective elevation rotary bearings 46A, 46B defining rotational elevation axis EL.

Figure 23:
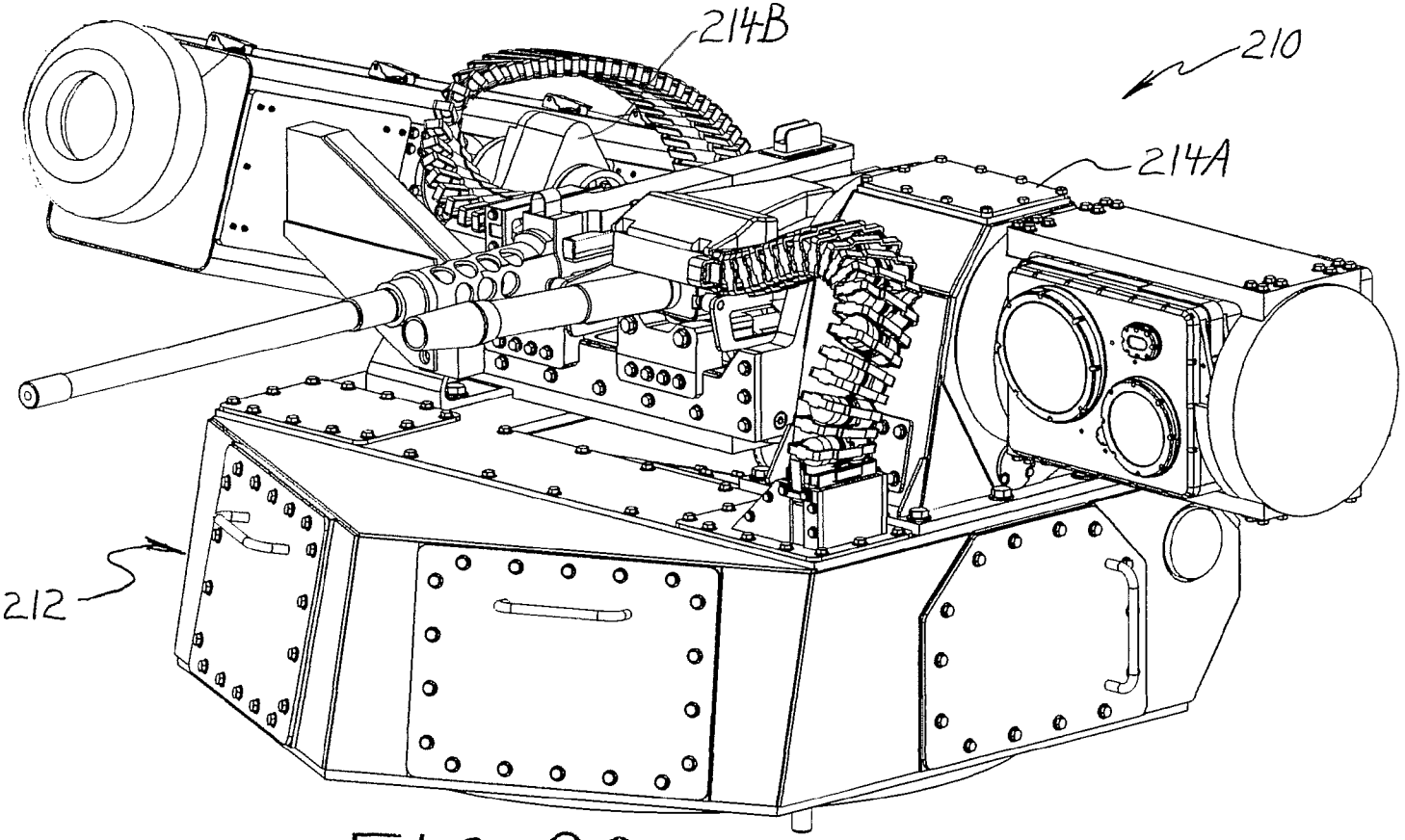
FIG. 23 is a perspective view of the RWS shown in FIG. 19 in its short configuration with weaponry and operational units mounted thereon.
Figure 24:
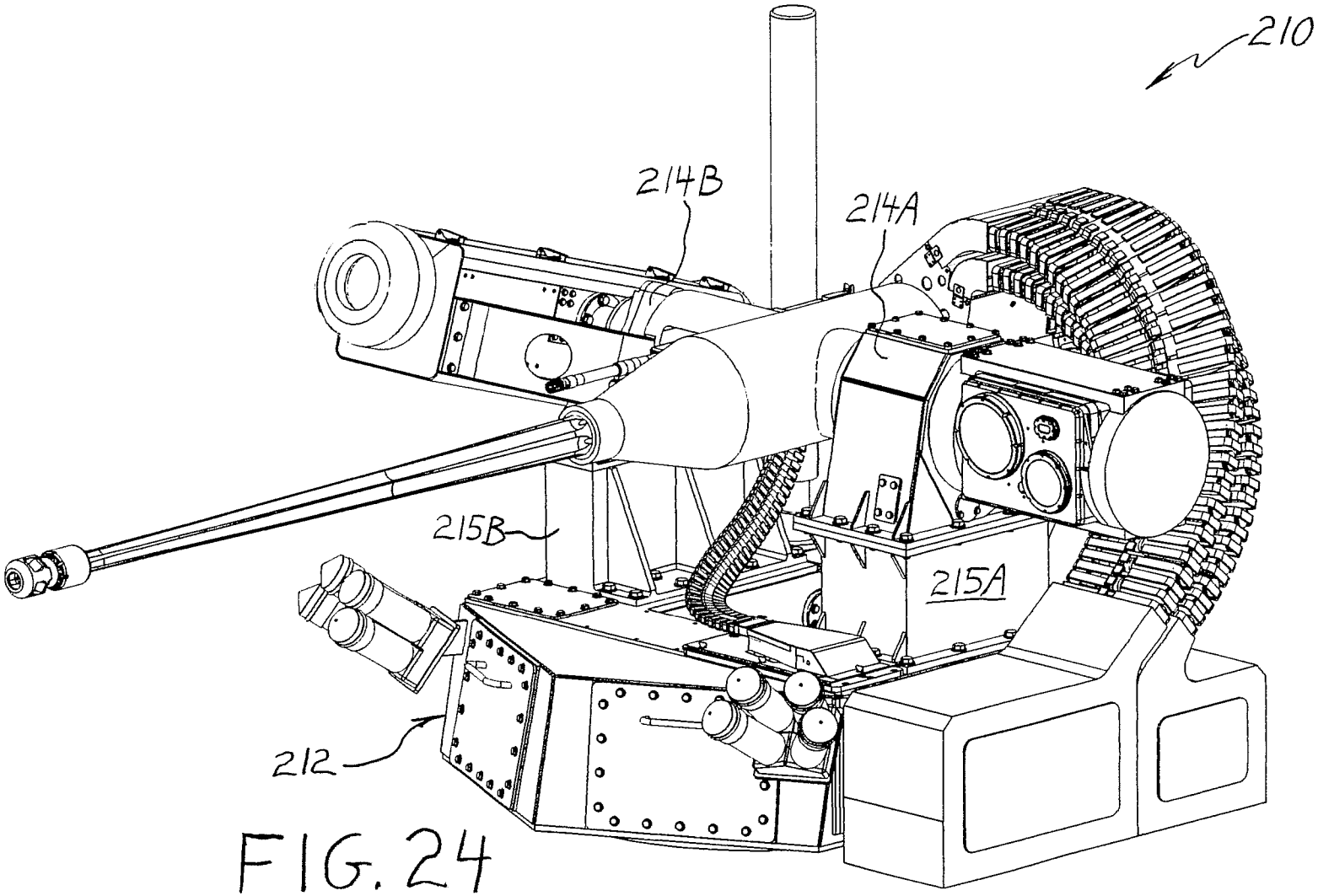
FIG. 24 is a perspective view of the RWS shown in FIG. 19 in its tall configuration with weaponry and operational units mounted thereon.

In the embodiment of FIGS. 19-24, elevation yoke arms 214A, 214B may be directly mounted on yoke arm attachment interfaces 34 to position elevation axis EL at a first height H1 (see FIGS. 20 and 23), and may also be indirectly mounted on yoke arm attachment interfaces 34 by way of a pair of spacers 215A, 215B to position elevation axis EL at a second height H2 different from first height H1 (see FIGS. 21 and 24). As may be understood, the bottom end of each elevation yoke arm 214A, 214B is configured to be removably mounted directly on the pair of yoke arm attachment interfaces 34, for example using threaded fasteners 44. The bottom end of each elevation yoke arm 214A, 214B is also configured for removable mounting on a respective attachment interface 234 at a top end of each spacer 215A, 215B using threaded fasteners 44. The bottom end of each spacer 215A, 215B is configured to be removably mounted directly on the pair of yoke arm attachment interfaces 34, for example using threaded fasteners 244. Thus, RWS 110 may be selectively configured in a short configuration as shown in FIGS. 20 and 23, or in a tall configuration as shown in FIGS. 21 and 24, depending upon whether spacers 215A, 215B are installed or not.

In the depicted embodiment, elevation yoke arm 214A is a driver elevation yoke arm that supports elevation drive motor 48, elevation rotary bearing 46A, and elevation drive hub 50, and elevation yoke arm 214B is a follower elevation yoke arm that supports elevation rotary bearing 46B and elevation follower hub 52. Advantageously, the elevation drive motor 48 may be coupled to the driver elevation yoke arm 214A and not coupled to the first spacer 215A, thereby facilitating selective installation and removal of spacer 215A to efficiently reconfigure RWS 210. First spacer 215A may be hollow as shown in FIG. 19 to freely receive drive hardware extending down from driver elevation yoke arm 214A.

In order to ensure axial alignment of elevation rotary bearings 46A, 46B in both the short and tall configurations, elevation rotary bearings 46A, 46B may be embodied as self-aligning ball bearings that are insensitive to slight misalignment of elevation drive hub 50 and elevation follower hub 52.

In an optional refinement of the invention, each of the first and second attachment interfaces 34 may define a plurality of different selectable attachment positions at which an elevation yoke arm 214A, 214B or a spacer 215A, 215B may be mounted on the attachment interface, whereby a longitudinal position (i.e. position fore to aft) of the elevation axis relative to the armored vehicle is adjustable. The attachment positions may be defined by providing further bolt holes 38 in each attachment interface 34. In another optional refinement of the invention, a lateral spacing between the driver elevation yoke arm 214A and the follower elevation yoke arm 214B differs depending upon whether or not the first spacer 215A and the second spacer 215B are installed. This may be achieved by configuring one or both spacers 215A, 215B such that its top-end attachment interface 234 defines an attachment location that is offset laterally (i.e. inboard or outboard) relative to the corresponding underlying attachment interface 34 on pedestal 12.

Figure 25:
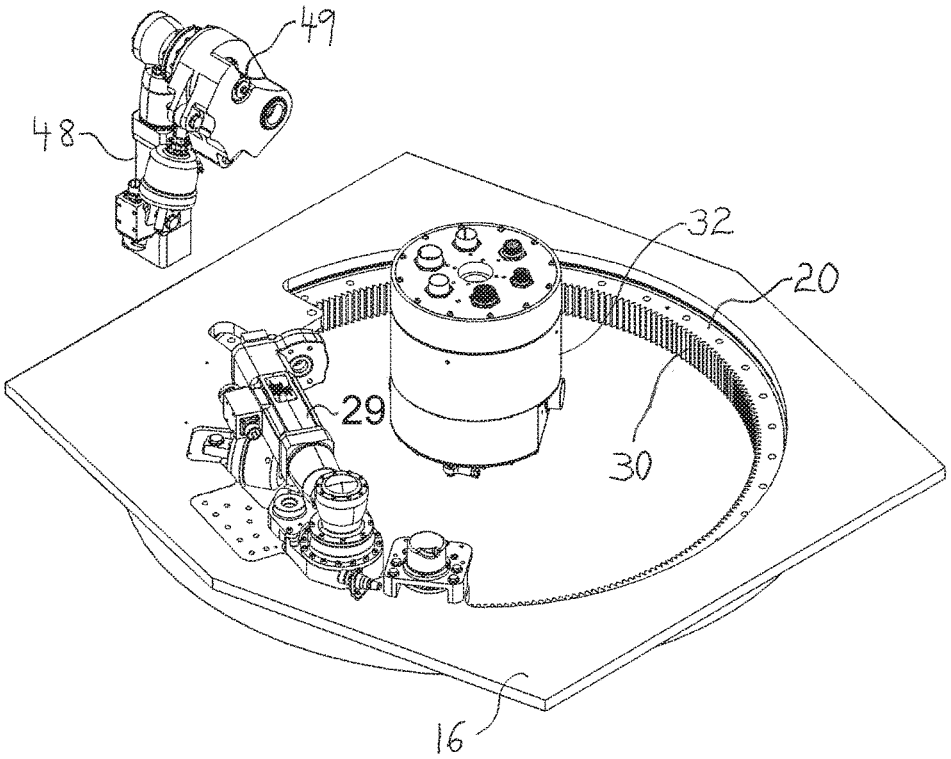
FIG. 25 is a perspective view showing a drive system of the RWS shown in FIG. 19.
Figure 26:
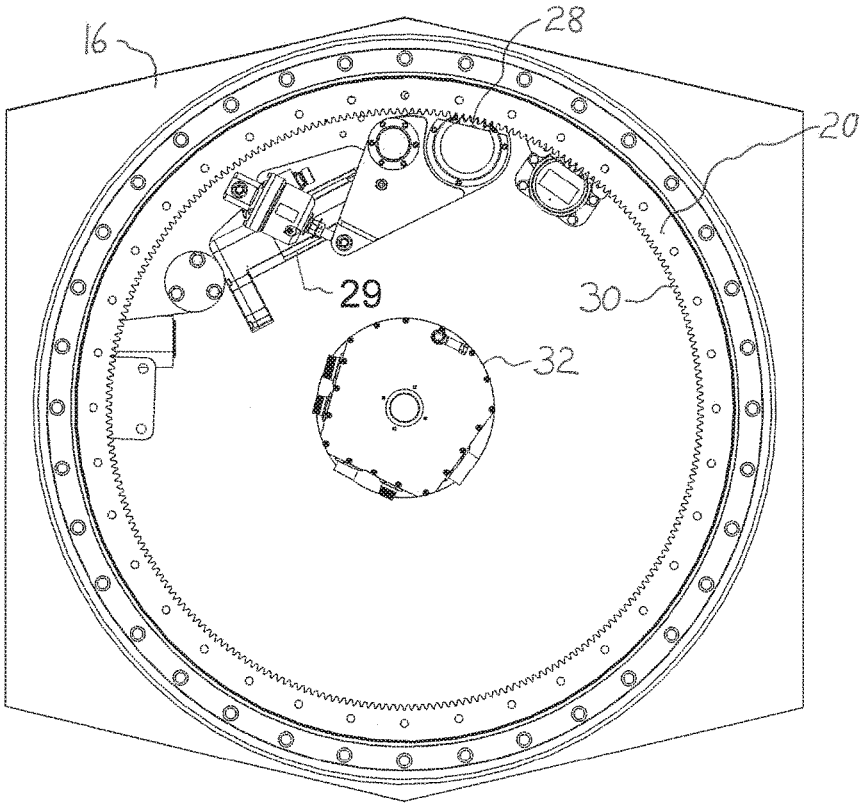
FIG. 26 is a bottom plan view of the drive system shown in FIG. 25.
Figure 27:
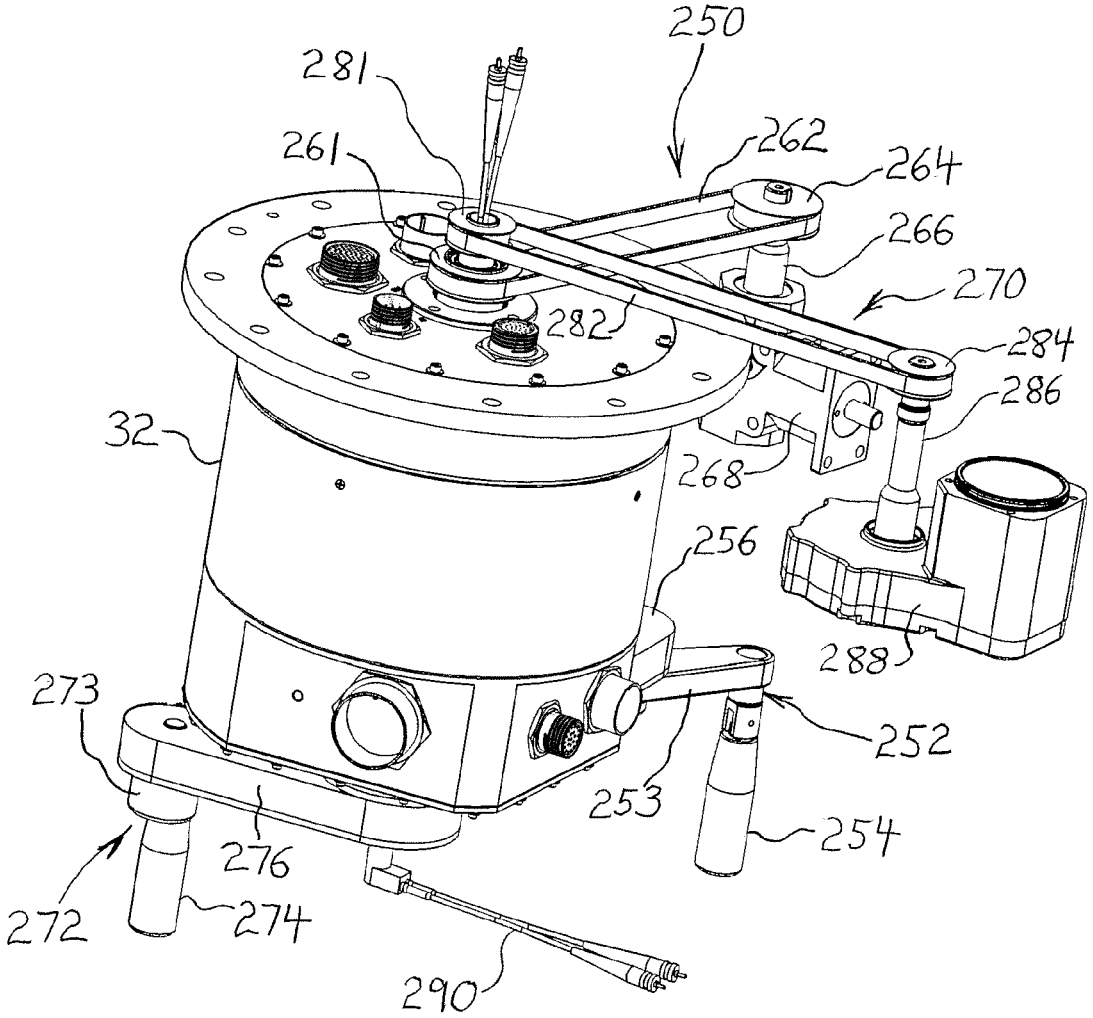
FIG. 27 is a top perspective view of an alternative drive system incorporating a manual drive train.
Figure 28:
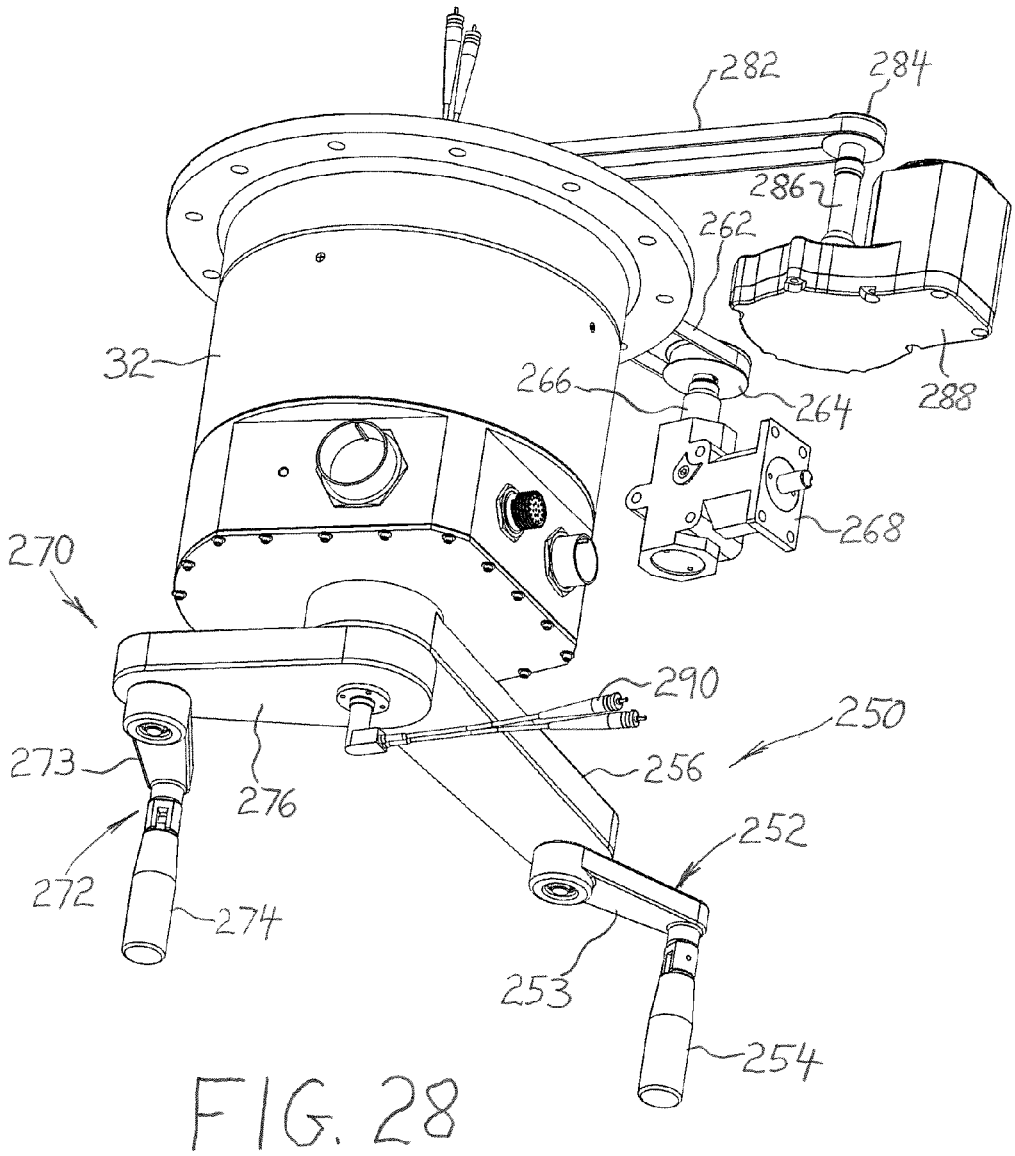
FIG. 28 is a bottom perspective view of the alternative drive system shown in FIG. 27.
Figure 29:
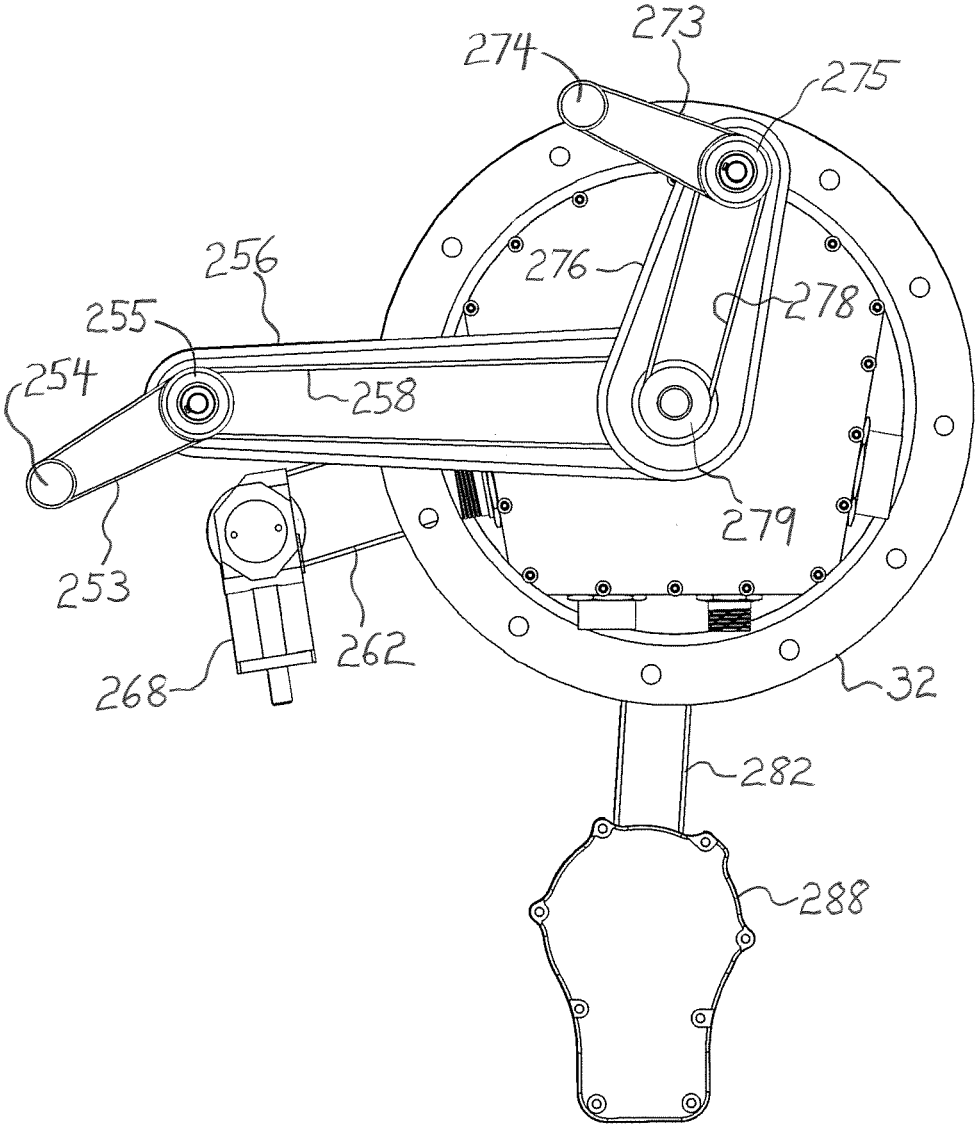
FIG. 29 is a bottom plan view of the alternative drive system shown in FIG. 27, wherein linkage arm covers are removed to reveal internal transmission structure.

FIGS. 25 and 26 illustrate a basic automated drive system of RWS 210. The basic drive system comprises an electrically-powered azimuth drive motor 29 operable to rotate output gear 28. The output gear 28 meshes with inner gear teeth 30 of inner race 20, wherein output gear 28 functions as an azimuth drive gear rotatable by azimuth drive motor 29 to rotate pedestal 12 and yoke arms 214A, 214B about azimuth axis AZ. The basic drive system also comprises electrically-powered elevation drive motor 48 operable to rotate output gear 49. The output gear 49 meshes with a gear train coupled to drive hub 50 (not shown in FIGS. 25 and 26), wherein output gear 49 functions as an elevation drive gear rotatable by elevation drive motor 48 to drive rotation of elevation drive hub 50 about elevation axis EL. In the illustrated embodiment, azimuth drive gear 28 and elevation drive gear 49 travel with pedestal 12 in rotating relative to the armored vehicle about the azimuth axis AZ. Slip ring assembly 32 may be incorporated in the basic drive system to provide signal transmission to and from control electronics associated with azimuth drive motor 29, elevation drive motor 48, and other electronic units in pedestal 12 across the rotational interface defined between pedestal 12 and the armored vehicle upon which pedestal 12 is mounted. In FIG. 25, components of the basic automated drive system are shown floating in space because supporting structure has been hidden for sake of clarity. For example, elevation drive motor 48 and elevation drive gear 49 are actually supported by elevation yoke arm 214A (not shown), and slip ring assembly 32 may actually be supported by pedestal 12.

In an aspect of the present invention, the basic automated drive system described above with reference to FIGS. 25 and 26 may be enhanced in space-efficient fashion to enable manual operation of azimuth drive gear 28 and elevation drive gear 49 in the event of a loss of electrical power to drive motors 29 and 48. As shown in FIGS. 27-30, an azimuth drive train 250 and an elevation drive train 270 may be incorporated into the drive system to enable manual operation. As will be described in greater detail below, azimuth drive train 250 is manually operable to rotate azimuth drive gear 28 to thereby rotate pedestal 12 and elevation yoke arms 214A, 214B about azimuth axis AZ, and elevation drive train 270 is manually operable to rotate elevation drive gear 49 to thereby rotate elevation hub 50 about the elevation axis EL.

Azimuth drive train 250 may generally include a crank 252, a transmission arm 256, a first transmission belt 258, a primary drive shaft 260, a second transmission belt 262, a secondary drive shaft 266, and a motor-input gearbox 268.

Figure 30:
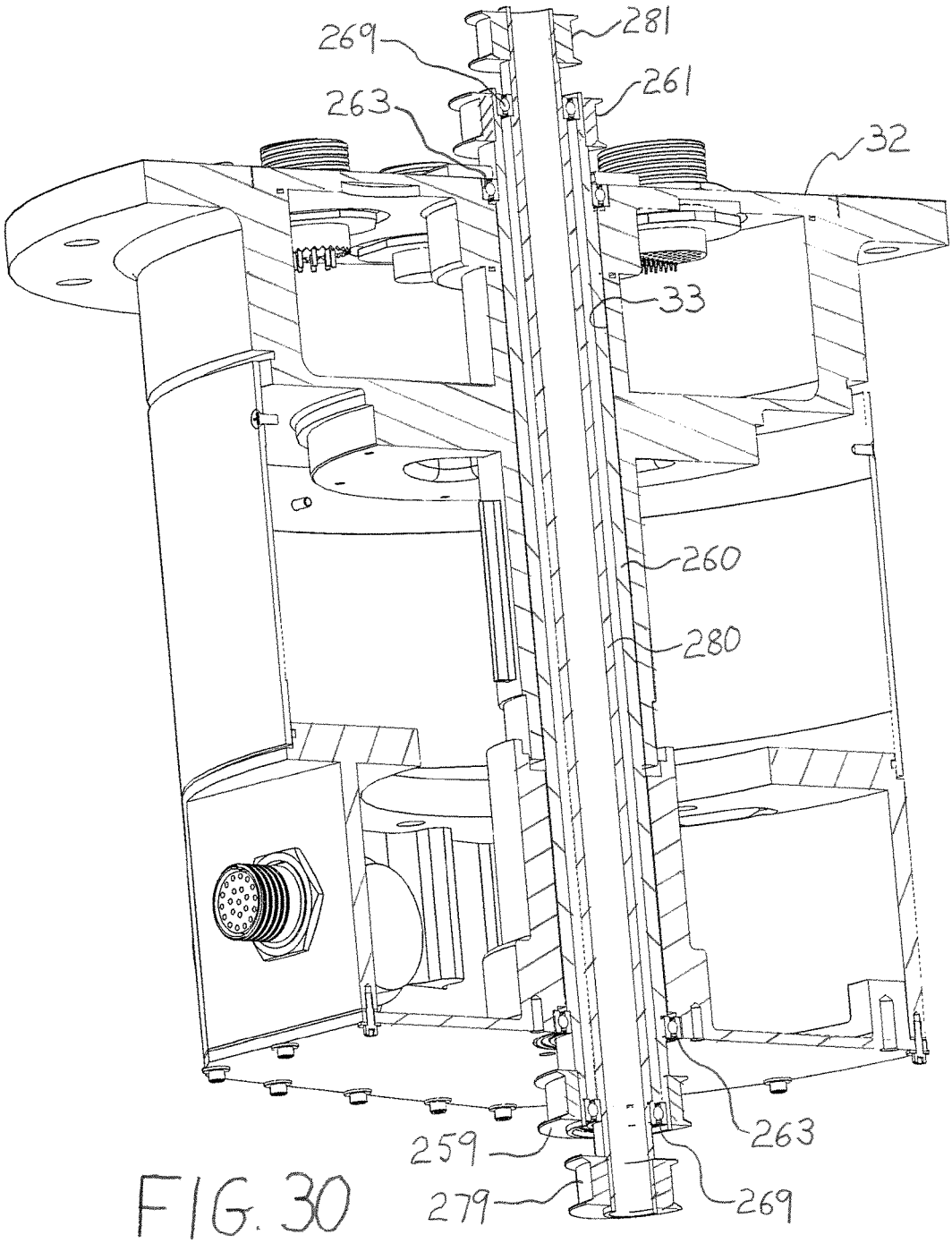
FIG. 30 is a cross-sectioned perspective view of a slip ring and a portion of the manual drive train of the alternative drive system.

Crank 252 may have a crank arm 253 and a handle 254. Crank arm 253 may be coupled at one end thereof to a first pulley 255, and handle 254 may be rotatably mounted at an opposite end of crank arm 253 to extend at a right angle relative to the longitudinal direction of crank arm 253. First pulley 255 may be rotatably mounted at a peripheral end of transmission arm 256 and connected by first transmission belt 258 to a second pulley 259. Second pulley 259 may be fixedly mounted to a bottom end of primary drive shaft 260. As will be understood, manual rotation of crank 252 will cause first pulley 255 to rotate, and this rotational motion is transmitted to second pulley 259 by first transmission belt 258, wherein primary drive shaft 260 is caused to rotate with second pulley 259. As best seen in FIG. 30, primary drive shaft 260 extends through a central axial passage 33 through slip ring assembly 32 and is rotatably mounted by a pair of rotary bearings 263 enabling primary drive shaft 260 to rotate relative to slip ring assembly 32. A third pulley 261 may be fixed to a top end of primary drive shaft 260 to rotate with primary drive shaft 260. Third pulley 261 may be connected by a second transmission belt 262 to a fourth pulley 264 fixedly mounted on secondary drive shaft 266, wherein rotation of third pulley 261 is transmitted to fourth pulley 264 by second transmission belt 262, thereby causing secondary drive shaft 266 to rotate. Secondary drive shaft 266 may be coupled to a manual input gearbox 268 associated with azimuth drive motor 29. Consequently, in a power outage situation, azimuth drive motor 29 may be powered manually to rotate azimuth drive gear 28 to achieve rotation of pedestal 12 about azimuth axis AZ relative to the armored vehicle.

Elevation drive train 270 is very similar to azimuth drive train 250 described above. Elevation drive train 270 may generally include a crank 272, a transmission arm 276, a first transmission belt 278, a primary drive shaft 280, a second transmission belt 282, a secondary drive shaft 286, and a motor-input gearbox 288.

Crank 272 may have a crank arm 273 and a handle 274, wherein crank arm 273 may be coupled at one end to a first pulley 275, and handle 274 may be rotatably mounted at an opposite end of crank arm 273 to extend at a right angle thereto. First pulley 275 may be rotatably mounted at a peripheral end of transmission arm 276 and connected by first transmission belt 278 to a second pulley 279 fixedly mounted to a bottom end of primary drive shaft 280. Thus, manual rotation of crank 272 will cause first pulley 275 to rotate, and this rotational motion is transmitted to second pulley 279 by first transmission belt 278. As a result, primary drive shaft 280 is caused to rotate with second pulley 259. As best seen in FIG. 30, primary drive shaft 280 of elevation drive train 270 extends through central axial passage 33 through slip ring assembly 32 by being coaxially nested to extend through primary drive shaft 260 of azimuth drive train 250, which is embodied as a tube sized to receive primary drive shaft 280. In the depicted embodiment, elevation primary drive shaft 280 is rotatably mounted within azimuth primary drive shaft 260 by a pair of rotary bearings 269 to enable shafts 260 and 280 to rotate independently of one another about a main axis of slip ring assembly 32 that may coincide with azimuth axis AZ. A third pulley 281 may be fixed to a top end of primary drive shaft 280 to rotate with primary drive shaft 280 and may be connected by a second transmission belt 282 to a fourth pulley 284 fixedly mounted on secondary drive shaft 286. Rotation of third pulley 281 is transmitted to fourth pulley 284 by second transmission belt 282, thereby causing secondary drive shaft 286 to rotate. Secondary drive shaft 286 may be coupled to a manual input gearbox 288 associated with elevation drive motor 48. Consequently, in a power outage situation, elevation drive motor 48 may be powered manually to rotate elevation drive gear 49 to achieve rotation of elevation drive hub 50 about elevation axis EL.

In an advantageous refinement, primary drive shaft 280 may be embodied as a hollow tube through which cables, for example fiber optic cables 290, may be routed from one side of the rotational interface to the other.

Figure 31:
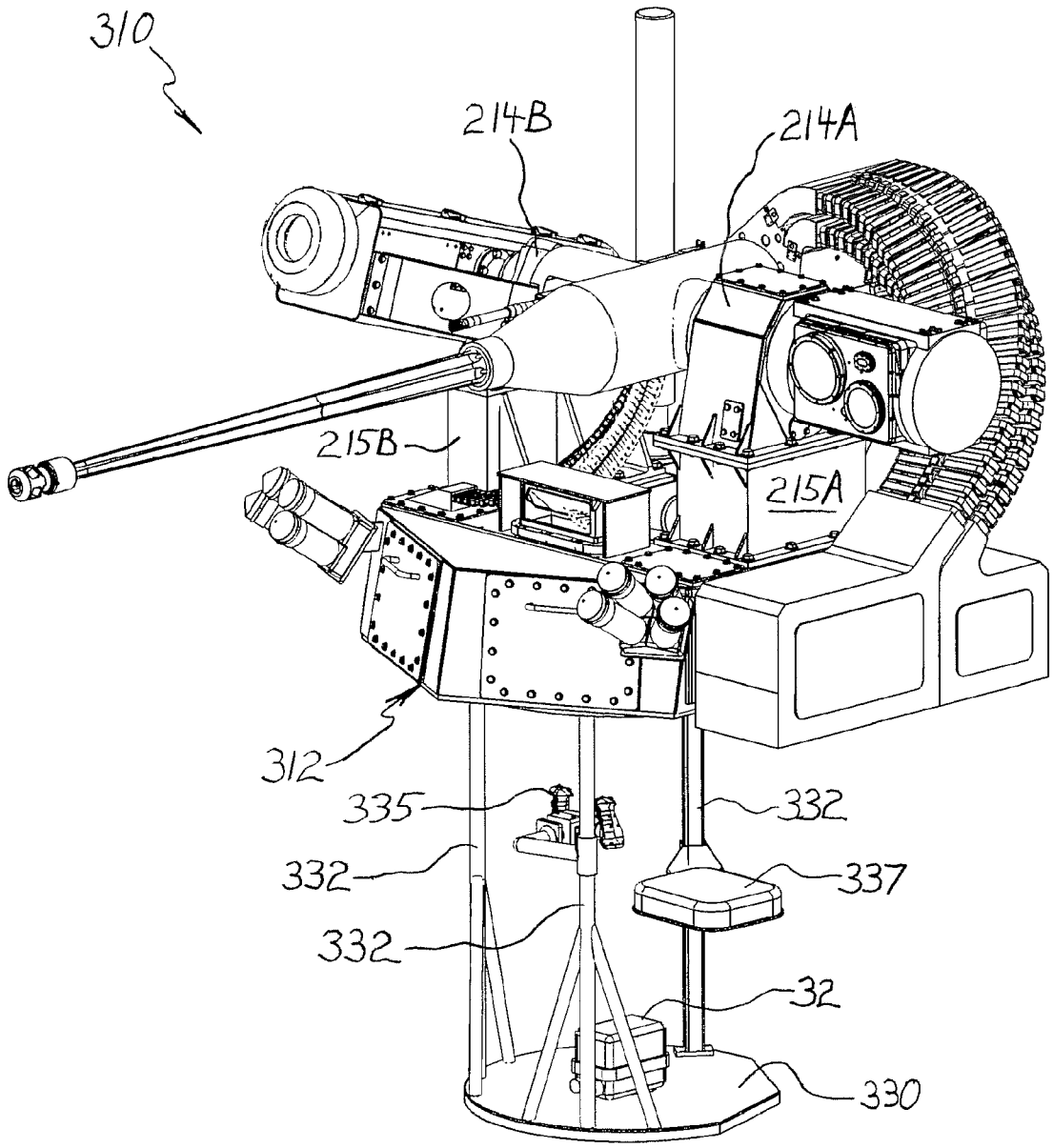
FIG. 31 is a perspective view of a manned weapon station formed in accordance with a further embodiment of the present invention, wherein the manned weapon station is based on the RWS shown in FIG. 19.
Figure 32:
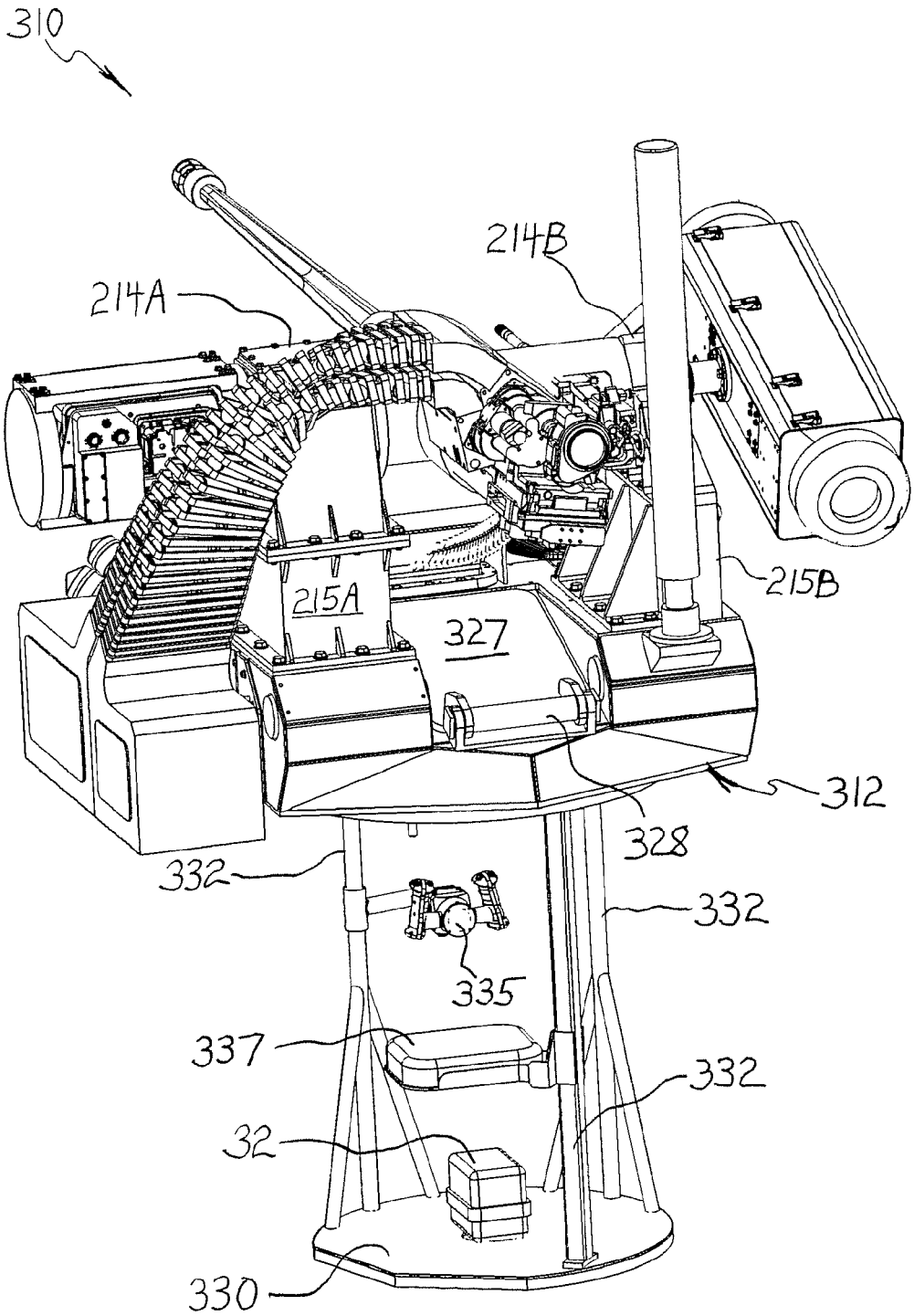
FIG. 32 is another perspective view of the manned weapon station shown in FIG. 31.
Figure 33:
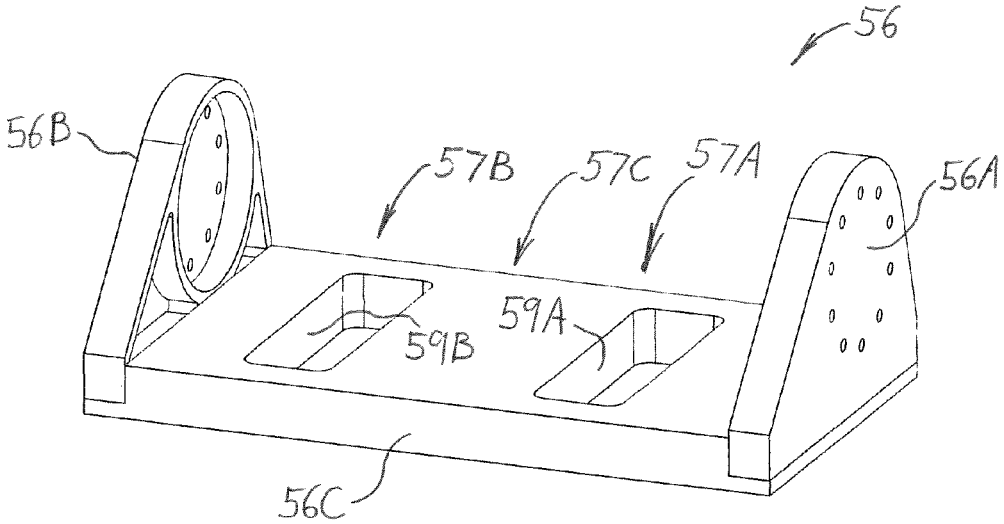
FIG. 33 is a perspective view of a weapon support cradle usable in an RWS of the present invention, wherein the cradle is shown in its non-inverted orientation.

As shown in FIGS. 31 and 32, the present invention may also be embodied by a manned weapon station apparatus 310. Similar to the RWS embodiments described above, manned weapon station apparatus 310 comprises a pedestal 312 adapted to be mounted on an armored vehicle for rotation relative to the armored vehicle about an azimuth axis AZ, and a weapon support yoke 314 carried by pedestal 312 and having laterally-spaced elevation yoke arms 214A, 214B extending upward from the pedestal, with or without optional spacers 215A, 215B as described above. Pedestal 312 may include a topside hatch 327 between elevation yoke arms 214A, 214B to enable a person to enter or exit an interior compartment of the pedestal. The illustrated embodiment depicts hatch 327 as being connected to the pedestal by a hinge 328, however a hatch 327 may be made to slide along tracks to open and close if a hinged hatch does not have clearance relative to mounted weaponry. Topside hatch 327 may be inclined relative to horizontal so that spent ammunition casings slide down and do not accumulate on the topside hatch.

Manned weapon station apparatus 310 further comprises a personnel support platform 330 suspended from pedestal 12 for rotation with the pedestal about azimuth axis AZ. Personnel support platform 330 may be suspended from pedestal 312 by one or more vertical structural member 332. A weapon control unit 335 and a seat 337 may be mounted on the same or different structural members 332 for accommodating an operator. Manned weapon station apparatus 310 may further comprise a periscope 340 allowing the operator to view external objects from within the interior compartment of the pedestal 312.

Manned weapon station apparatus 310 may further comprise slip ring assembly 32 configured to transmit power and data across a rotary interface established between pedestal 312 and the armored vehicle. In the depicted embodiment, slip ring assembly 32 is mounted to the personnel support platform 320 in alignment with azimuth axis AZ. Alternatively, slip ring assembly 32 may be movably mounted to an inner wall of pedestal 12, for example by a pantograph arm or other mechanical arm that enables the slip ring assembly to be displaced within interior compartment 24. A user may then selectively align slip ring assembly 32 with azimuth axis AZ for pedestal rotations, or move slip ring assembly 32 out of the way for using topside hatch 327.

The description above relating to selective configuration of the height of elevation axis EL for RWS embodiments applies equally to the manned weapon station embodiment shown in FIGS. 31 and 32.

While the invention has been described in connection with exemplary embodiments, the detailed description is not intended to limit the scope of the invention to the particular forms set forth. The invention is intended to cover such alternatives, modifications and equivalents of the described embodiment as may be included within the spirit and scope of the invention.

What is claimed is:

1. A weapon station apparatus comprising:

a pedestal adapted to be mounted on an armored vehicle for rotation relative to the armored vehicle about an azimuth axis, the pedestal including a first attachment interface and a second attachment interface laterally-spaced from the first attachment interface;

a first spacer including a bottom end configured for removable mounting on the first attachment interface of the pedestal and a top end having a yoke arm attachment interface;

a second spacer including a bottom end configured for removable mounting on the second attachment interface of the pedestal and a top end having a yoke arm attachment interface;

a driver elevation yoke arm configured for removable mounting on the first attachment interface of the pedestal and for removable mounting on the yoke arm attachment interface of the first spacer;

a follower elevation yoke arm configured for removable mounting on the second attachment interface of the pedestal and for removable mounting on the yoke arm attachment interface of the second spacer; and a first elevation rotary bearing supported by the driver elevation yoke arm and a second elevation rotary bearing supported by the follower elevation yoke arm, wherein the first and second elevation rotary bearings define a rotational elevation axis;

wherein the first spacer is selectably installable between the pedestal and the driver elevation yoke arm and the second spacer is selectably installable between the pedestal and the follower elevation yoke arm to change a height of the elevation axis above the pedestal;

wherein each of the first and second attachment interfaces includes fastener holes defining a plurality of selectable attachment positions spaced in a longitudinal direction of the pedestal, whereby a longitudinal position of the elevation axis relative to the armored vehicle is adjustable.

2. The weapon station apparatus according to claim 1, further comprising:

an elevation drive motor;

an elevation drive hub connected to the elevation drive motor and supported by the first elevation rotary bearing, wherein the elevation drive hub is rotatable about the elevation axis by operation of the elevation drive motor; and an elevation follower hub supported by the second elevation rotary bearing;

wherein the elevation drive hub and the elevation follower hub are configured for removable mounting of a primary weapon thereto such that the primary weapon resides between the driver and follower elevation yoke arms and is rotatable about the elevation axis by operation of the elevation drive motor.

3. The weapon station apparatus according to claim 2, wherein the elevation drive motor is coupled to the driver elevation yoke arm and is not coupled to the first spacer.

4. The weapon station apparatus according to claim 1, wherein the first and second elevation rotary bearings are self-aligning rotary bearings.

5. The weapon station apparatus according to claim 1, wherein the top end attachment interface of at least one of the first and second spacers is offset laterally relative to the corresponding attachment interface of the pedestal, whereby a lateral spacing between the driver elevation yoke arm and the follower elevation yoke arm differs depending upon whether or not the first spacer and the second spacer are installed.

6. A weapon station apparatus comprising:

a pedestal adapted to be mounted on an armored vehicle for rotation relative to the armored vehicle about an azimuth axis;

a yoke assembly carried by the pedestal, the yoke assembly being adapted to support at least one weapon for rotation relative to the pedestal about an elevation axis, wherein the yoke assembly includes an elevation hub rotatable about the elevation axis;

an azimuth drive gear rotatable to drive rotation of the pedestal about the azimuth axis;

an elevation drive gear rotatable to drive rotation of the elevation drive hub about the elevation axis;

an azimuth drive motor operable by electric power to rotate the azimuth drive gear to thereby rotate the pedestal and yoke assembly about the azimuth axis;

an elevation drive motor operable by electric power to rotate the elevation drive gear to thereby rotate the elevation hub about the elevation axis;

an azimuth drive train manually operable to rotate the azimuth drive gear to thereby rotate the pedestal and yoke assembly about the azimuth axis;

an elevation drive train manually operable to rotate the elevation drive gear to thereby rotate the elevation hub about the elevation axis;

a slip ring configured to transmit power and data across a rotary interface defined by the pedestal and the armored vehicle, wherein the slip ring includes a passageway extending through the slip ring across the rotary interface, and at least one of the azimuth drive train and the elevation drive train extends through the passageway.

7. The weapon station apparatus according to claim 6, wherein both of the azimuth drive train and the elevation drive train extend through the passageway.

8. The weapon station apparatus according to claim 6, wherein the azimuth drive gear and the elevation drive gear are coupled to the pedestal and rotate with the pedestal relative to the armored vehicle about the azimuth axis.

* * * * *